US009981494B2

(12) United States Patent
Ono et al.

(10) Patent No.: US 9,981,494 B2
(45) Date of Patent: May 29, 2018

(54) WASTE LIQUID CONTAINER

(71) Applicant: SEIKO EPSON CORPORATION, Tokyo (JP)

(72) Inventors: Hirokazu Ono, Suwa (JP); Yoshihiro Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/290,729

(22) Filed: Oct. 11, 2016

(65) Prior Publication Data

US 2017/0106687 A1 Apr. 20, 2017

(30) Foreign Application Priority Data

Oct. 14, 2015 (JP) ..... 2015-202685

(51) Int. Cl.

| | |
|---|---|
| ***B41J 29/17*** | (2006.01) |
| ***B41J 2/165*** | (2006.01) |
| ***B41J 2/17*** | (2006.01) |

(52) U.S. Cl.

CPC ..... *B41J 29/17* (2013.01); *B41J 2/165* (2013.01); *B41J 2/16508* (2013.01); *B41J 2/16523* (2013.01); *B41J 2/16585* (2013.01); *B41J 2/1721* (2013.01)

(58) Field of Classification Search

CPC ..... B41J 29/17; B41J 2/165

See application file for complete search history.

(56) References Cited

U.S. PATENT DOCUMENTS

| | | | | |
|---|---|---|---|---|
| 2005/0057622 | A1* | 3/2005 | Kimura | B41J 2/16523 347/86 |
| 2007/0008372 | A1* | 1/2007 | Katada | B41J 2/1721 347/36 |
| 2009/0219339 | A1* | 9/2009 | Harada | B41J 2/1721 347/36 |
| 2012/0234436 | A1* | 9/2012 | Harada | B41J 2/1721 141/383 |
| 2013/0321538 | A1* | 12/2013 | Ishizawa | B41J 2/17506 347/86 |
| 2015/0290945 | A1* | 10/2015 | Naito | B41J 2/17509 347/86 |
| 2015/0314605 | A1 | 11/2015 | Hirasawa et al. | |

FOREIGN PATENT DOCUMENTS

| | | |
|---|---|---|
| JP | 2005-047089 A | 2/2005 |
| JP | 2012-196798 A | 10/2012 |
| JP | 2015-208991 A | 11/2015 |

* cited by examiner

*Primary Examiner* — Bradley Thies
(74) *Attorney, Agent, or Firm* — Workman Nydegger

(57) ABSTRACT

A waste liquid container is mounted on a mounting portion including a discharging portion discharging waste liquid and an apparatus-side terminal portion in accordance with movement in a mounting direction. The waste liquid container includes a waste liquid containing chamber which is capable of containing the waste liquid, a connection opening which is opened in the mounting direction in a shape of being connectable to the discharging portion, and a container-side terminal portion which is electrically connected to the apparatus-side terminal portion at the time of being mounted on the mounting portion. In a state of being mounted on the mounting portion, the container-side terminal portion is disposed lower than the connection opening in a posture of being inclined with respect to the mounting direction.

10 Claims, 22 Drawing Sheets

WASTE LIQUID CONTAINER

BACKGROUND

1. Technical Field

The present invention relates to a waste liquid container for containing waste liquid such as waste ink.

2. Related Art

As an example of a liquid ejecting apparatus, there is an ink jet type printer which discharges liquid as waste liquid from a liquid ejecting head for a purpose of releasing clogging of the liquid ejecting head, and a waste liquid container for containing the discharged waste liquid may be mounted on such a printer (for example, JP-A-2012-196798).

However, if the waste liquid container is filled with the waste liquid and the waste liquid is leaked out from the waste liquid container mounted on the printer, there is a problem in that the waste liquid contaminates the inside and the outside of the printer.

Also, such a problem is not limited to an ink jet type printer ejecting ink, and is generally common in waste liquid containers which are mounted on an apparatus that discharges waste liquid.

SUMMARY

An advantage of some aspects of the invention is to provide a waste liquid container which enables early detecting of a leak of waste liquid.

Hereinafter, means of the invention and operation effects thereof will be described.

According to an aspect of the invention, there is provided a waste liquid container which is mounted on a mounting portion including a discharging portion discharging waste liquid and an apparatus-side terminal portion in accordance with movement in a mounting direction, the container including a waste liquid containing chamber that is capable of containing the waste liquid, a connection opening that is opened in the mounting direction in a shape of being connectable to the discharging portion, and a container-side terminal portion that is electrically connected to the apparatus-side terminal portion at the time of being mounted on the mounting portion, in which, in a state of being mounted on the mounting portion, the container-side terminal portion is disposed lower than the connection opening in a posture of being inclined with respect to the mounting direction.

According to this configuration, when the waste liquid container is mounted on the mounting portion, the container-side terminal portion is positioned lower than the connection opening, and if the waste liquid flows down by being leaked from the connection opening, the waste liquid adheres to the container-side terminal portion. As a result of this, an electric connection between the container-side terminal portion and the apparatus-side terminal portion is changed, and thus the leaking of the waste liquid can be detected. In addition, since the container-side terminal portion is disposed in a posture being inclined with respect to the mounting direction, the waste liquid flowing out from the connection opening flows along the incline, and can more efficiently adhere to the container-side terminal portion. Accordingly, since the leak can be detected before the waste liquid leaked from the connection opening is spread to the vicinity thereof, the leak of the waste liquid can be detected early.

In the waste liquid container, the mounting portion may include a locking portion, the waste liquid container may further include an engaging portion which is engaged with the locking portion at the time of being mounted on the mounting portion, and the engaging portion may be disposed on a position aligned with the container-side terminal portion in a direction intersecting a vertical direction.

According to this configuration, the position of the waste liquid container is determined when the locking portion is engaged with the engaging portion at the time of being mounted on the mounting portion. The engaging portion is disposed on the position aligned with the container-side terminal portion in the direction intersecting the vertical direction, and thus the position of the container-side terminal portion at the time of being mounted can be accurately determined. Accordingly, the accuracy of connection between the container-side terminal portion and the apparatus-side terminal portion can be improved.

In the waste liquid container, the mounting portion may include an optical sensor which includes a light emitting portion emitting light and a light receiving portion capable of receiving light, and the waste liquid container may further include a reflecting portion, which is capable of reflecting light emitted from the light emitting portion to the light receiving portion in a state of being mounted on the mounting portion.

According to this configuration, in a case in which the waste liquid container is mounted on the mounting portion, the optical sensor receives light reflected by the reflecting portion, and in a case in which the waste liquid container is not mounted on the mounting portion, the optical sensor does not receive the light. Accordingly, a mounting state of the waste liquid container can be detected by the optical sensor.

In the waste liquid container, the mounting portion may include a locking portion, the waste liquid container may further include an engaging portion which is engaged with the locking portion at the time of being mounted on the mounting portion, and the reflecting portion may be disposed on a position aligned with the engaging portion in a direction intersecting a vertical direction.

According to this configuration, the position of the waste liquid container is determined with the locking portion engaged with the engaging portion at the time of being mounted on the mounting portion. The engaging portion is disposed on a position aligned with the reflecting portion in a direction intersecting a vertical direction, and thus the position of the reflecting portion at the time of being mounted can be more accurately determined. Accordingly, the optical sensor can receive the light reflected from the reflecting portion with improved accuracy.

In the waste liquid container, the reflecting portion may be a prism in which a reflection state of light changes according to the presence or absence of the waste liquid inside the waste liquid container.

According to this configuration, in the reflecting portion, a transmitting state of the light is changed according to the presence or absence of the waste liquid inside the waste liquid container, and thus a containing state of the waste liquid in the waste liquid container can be detected by the optical sensor.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to drawings.

A liquid ejecting apparatus 11 of the embodiment is an ink jet type printer which performs recording (printing) by ejecting ink, which is an example of liquid, onto a medium S such as paper transported in a transportation direction Y intersecting with ("orthogonal to" in the embodiment) an ejecting direction Z of liquid.

Figure 1:
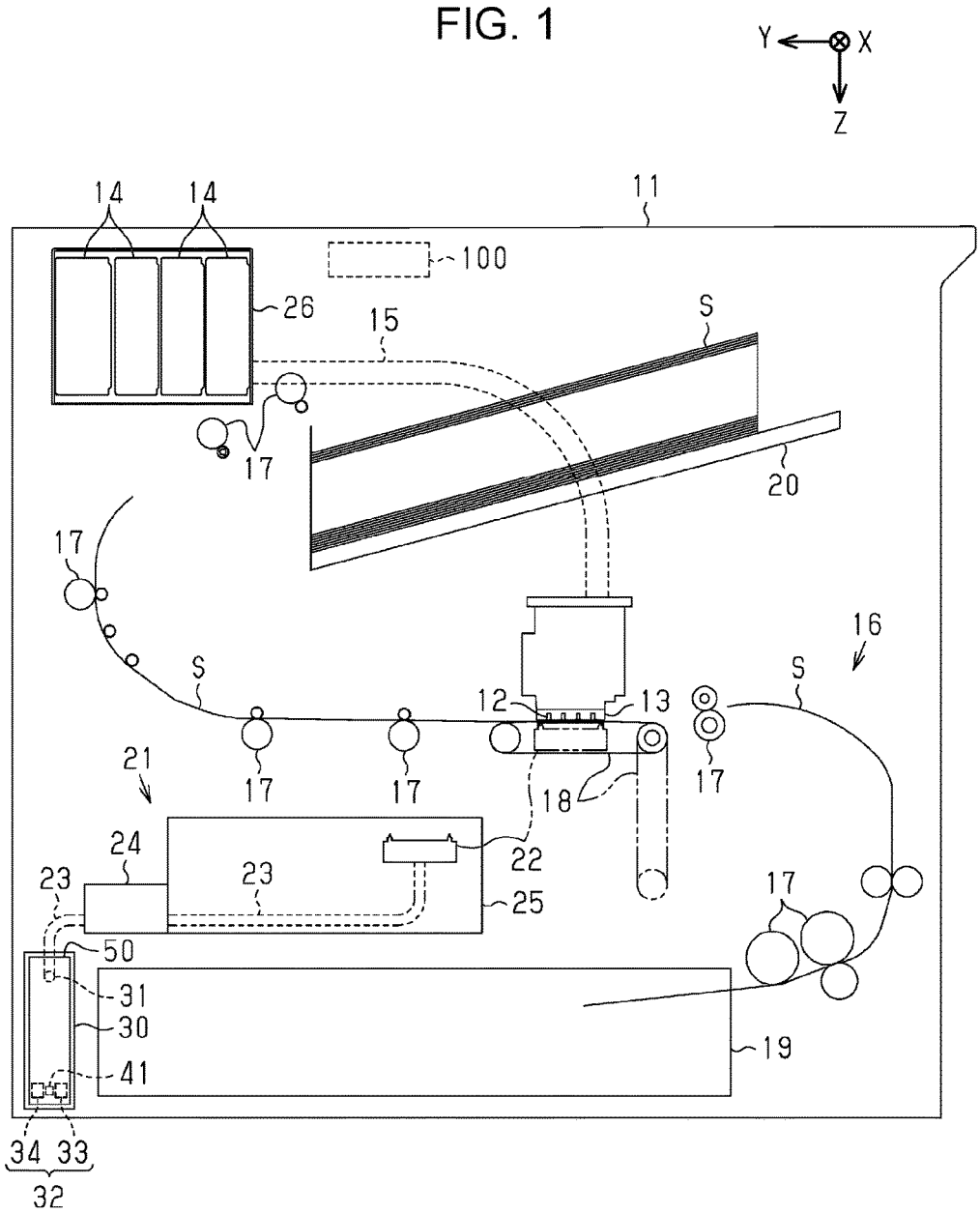
FIG. 1 is a perspective view of a liquid ejecting apparatus in which a waste liquid container is mounted.

As illustrated in FIG. 1, the liquid ejecting apparatus 11 is provided with a liquid ejecting portion 13 in which one or a plurality of nozzles 12 capable of ejecting liquid droplets are opened, a supplying passage 15 for supplying liquid of a liquid supplying source 14 toward the liquid ejecting portion 13, a transportation apparatus 16 transporting a medium S, and a controller 100 controlling these components. If a position to which the liquid ejecting portion 13 is ejected is set to a recording position, the transportation apparatus 16 is provided with a plurality of transportation rollers 17 which transports the medium S along a transportation passage passing through the recording position, and a transportation belt 18 which transports the medium S in the recording position. Moreover, a transportation direction Y indicates a transportation direction of the medium S in the recording position.

The liquid ejecting portion 13 of the embodiment is a line head in which a printing range in a width direction X intersecting with ("orthogonal to" in the embodiment) a transportation direction Y and an ejecting direction Z is throughout an entire width of the medium S. In the embodiment, the ejecting direction Z is a gravity direction, but both of a horizontal direction and the gravity direction can be set as the ejecting direction Z.

The liquid supplying source 14 can be adopted as, for example, a cartridge type liquid container which is mounted on be detachable from a container mounting portion 26 included in the liquid ejecting apparatus 11. In addition, the liquid supplying source 14 may be a unit which supplies liquid by pouring the liquid to a liquid tank mounted on the container mounting portion 26.

The liquid ejecting apparatus 11 is provided with a containing sensor 19 which is capable of containing a plurality of the mediums S before printing, a holding tray 20 holding the medium S which is printed, a maintenance apparatus 21 which maintains the liquid ejecting portion 13, and the mounting portion 30 in which a waste liquid container 50 containing waste liquid generated in accordance with maintaining, or the like of the liquid ejecting portion 13 is mounted.

In the liquid ejecting apparatus 11, in the liquid ejecting portion 13, in order to prevent or solve an ejecting defect generated due to clogging of the nozzle 12 or attaching of foreign material, a maintenance operation such as flushing, capping, or suction cleaning is performed. The maintenance apparatus 21 is provided with a cap 22, a waste liquid flow passage 23 which connects the cap 22 and the mounting portion 30, a suction pump 24 provided in an intermediate part of the waste liquid flow passage 23, and a moving mechanism 25.

The moving mechanism 25 moves the cap 22 between a retractable position illustrated by a solid line in FIG. 1 and a capping position (illustrated by a two-dot chain line in FIG. 1) in contact with the liquid ejecting portion 13. Also, the transportation belt 18 is retracted from a supporting position illustrated by a solid line in FIG. 1 to the retractable position illustrated by a two-dot line in FIG. 1 when the cap 22 is moved to the capping position.

The cap 22 moves to the capping position and comes into contact with the liquid ejecting portion 13 so as to surround the nozzle 12, and thus capping is performed. When liquid is not ejected, an ejecting defect is prevented to be generated by performing capping and suppressing a dry of the nozzles 12.

The flushing is ejecting (discharging) liquid droplets forcedly from the nozzle 12 regardless printing, and discharging foreign material, bubbles, liquid (for example, ink thickened due to evaporation of solvent components) having changed properties which causes ejecting defect. The liquid discharged as the waste liquid by flushing may be accepted by the cap 22, and a flushing box for accepting the waste liquid discharged by flushing may be separately formed.

In addition, if the suction pump 24 is driven in a state in which the cap 22 is disposed on the capping position, and a negative pressure is exerted to the nozzle 12, suction cleaning is performed in which liquid is sucked and discharged from the nozzle 12 due to the negative pressure. The liquid discharged from the nozzle 12 by the suction cleaning is contained in the waste liquid container 50 as a waste liquid. In addition, in a case in which the waste liquid discharged by the flushing is contained in the cap 22, the suction pump 24 is driven in a state in which the cap 22 is separated from the liquid ejecting portion 13, and thus the waste liquid accepted in the cap 22 is contained in the waste liquid container 50 through the waste liquid flow passage 23.

Moreover, at the time of starting to use the liquid ejecting apparatus 11, liquid is filled in a region where the liquid flows from the liquid supplying source 14 to the nozzle 12 by performing the suction cleaning. This is an initial filling.

Figure 2:
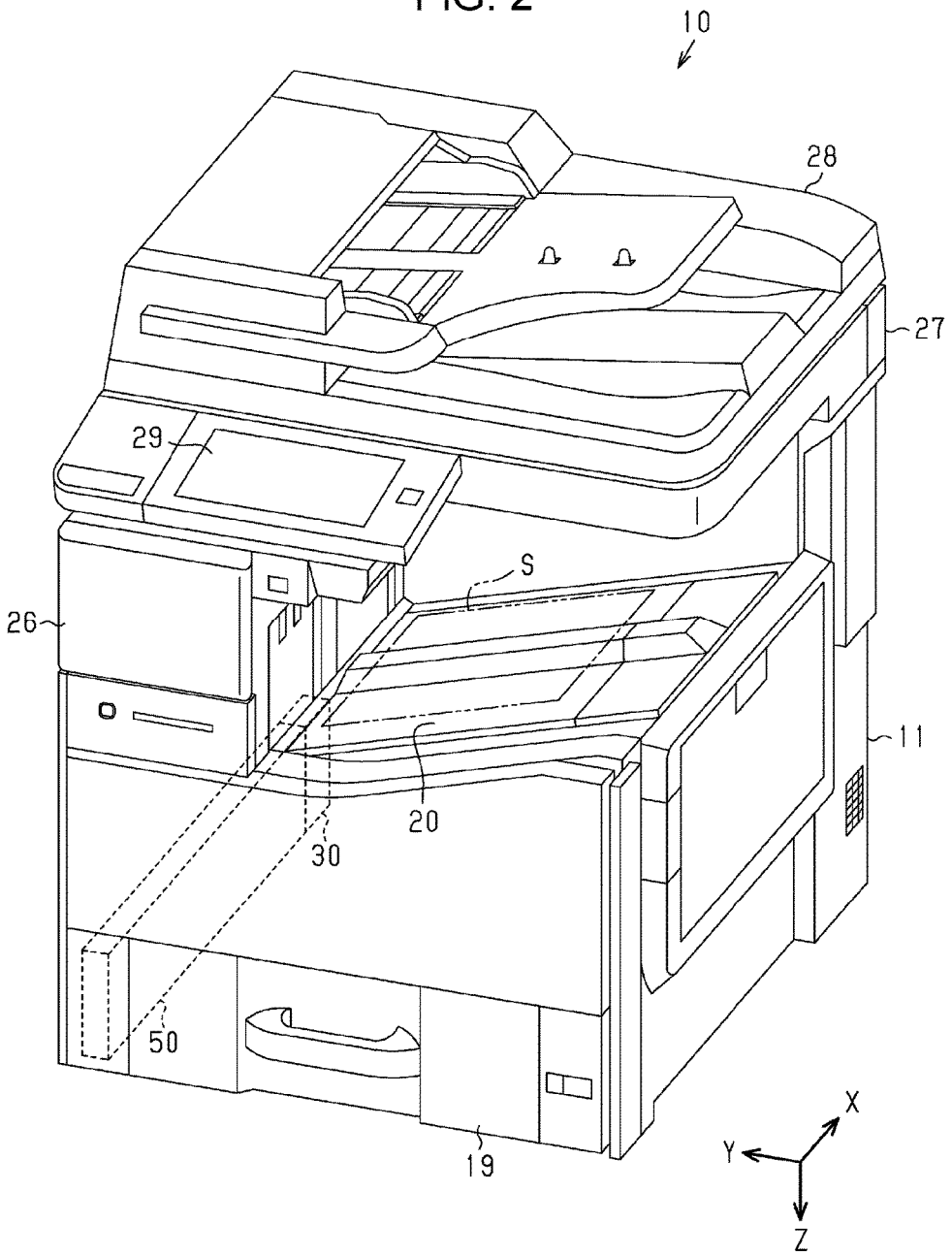
FIG. 2 is a perspective view of a complex machine which is provided with the liquid ejecting apparatus of FIG. 1.

As illustrated in FIG. 2, the liquid ejecting apparatus 11 can be set as a complex machine 10 in which an image reader 27 and an automatic feeding apparatus 28 are mounted in a vertical upper direction. In addition, in a case in which an operation with respect to the containing sensor 19, the holding tray 20, or the container mounting portion 26 is performed from the front, an operating portion 29 which is configured with a liquid crystal panel, or the like may be provided on a position which becomes a front side of the complex machine 10. In this case, the liquid ejecting apparatus 11 can be operated by an operation with respect to the operating portion 29.

In the embodiment, the mounting portion 30 is positioned on a downward bottom side nearer than the container mounting portion 26 in the liquid ejecting apparatus 11, and disposed near an end portion (left end portion when seen from front side) of a downstream side of the transportation direction Y. In addition, since the waste liquid container 50 is mounted on the mounting portion 30 according to movement to the width direction X with respect to the liquid ejecting apparatus 11, the width direction X becomes the mounting direction. In addition, in the waste liquid container 50, the mounting direction becomes a longitudinal direction, and the mounting portion 30 is disposed on a rear side which becomes a depth side of the mounting direction in the liquid ejecting apparatus 11.

Next, a configuration of the mounting portion 30 will be described in detail.

Figure 3:
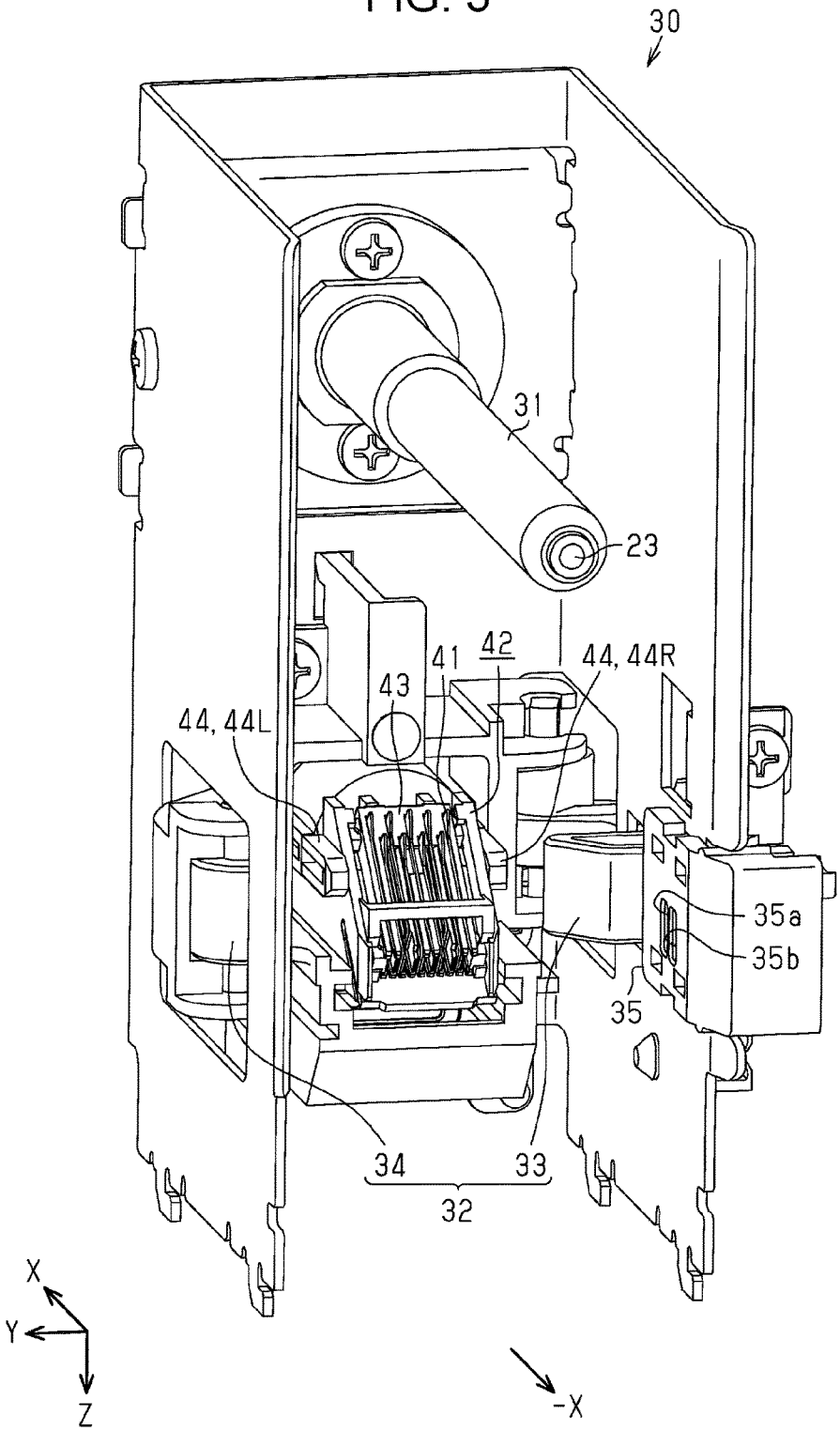
FIG. 3 is a perspective view of a mounting portion in which the waste liquid container is mounted.

As illustrated in FIG. 3, the mounting portion 30 includes a discharging portion 31 for discharging a waste liquid, a position determining portion 32 determining a position of the waste liquid container 50, and an apparatus-side terminal portion 41 which is electrically connected to the waste liquid container 50.

In the mounting portion 30, the discharging portion 31 is disposed on upper side than the apparatus-side terminal portion 41, and the position determining portion 32 is disposed on a position in the transportation direction Y in parallel with the apparatus-side terminal portion 41. The position determining portion 32 is provided with a locking portion 33 in a hook shape which is disposed on an upstream (right side in FIG. 3) of the transportation direction Y upper than the apparatus-side terminal portion 41, and a contacting roller 34 which is disposed on a downstream in the transportation direction Y lower than the apparatus-side terminal portion 41 (left side in FIG. 3), such that the apparatus-side terminal portion 41 is pinched therebetween and faces the position determining portion with each other.

The discharging portion 31 is a substantially cylindrical shape protruding in an extracting direction-X which becomes an opposite direction of the mounting direction, and a downstream end of the waste liquid flow passage 23 is opened to a cylindrical shape distal end. In addition, the mounting portion 30 includes a terminal holding portion 42 which holds the apparatus-side terminal portion 41 to be inclined by being protruded in the extracting direction-X in a same manner as that of the discharging portion 31, and an optical sensor 35 which is disposed on a front side in the mounting direction further than the terminal holding portion 42 and the locking portion 33.

The optical sensor 35 is a reflecting type optical sensor which includes a light emitting portion 35*a* reflecting light and a light receiving portion 35*b* receiving light. The light emitting portion 35*a* includes, for example, a light emitting diode, and is disposed on a position where light is applied in the transportation direction Y toward the waste liquid container 50 mounted on the mounting portion 30. The light receiving portion 35*b* includes, for example, a phototransistor, and is disposed on a position where a reflected light of the light applied from the light emitting portion 35*a* to the waste liquid container 50 can be received.

The terminal holding portion 42 includes an inclined surface 43 which intersects to be inclined in both of the gravity direction and the mounting direction and is formed so that the distal end side (the extracting direction-X side) is lowered, and the apparatus-side terminal portion 41 is formed as a plate spring able to be protruded toward a top of the incline from the inclined surface 43.

The terminal holding portion 42 includes a pair of the guiding convex portions 44 (44L and 44R) which is positioned on both sides of the inclined surface 43 in the transportation direction Y. The guiding convex portion 44L in the transportation direction Y is disposed between the inclined surface 43 and a contacting roller 34, and the guiding convex portion 44R in the transportation direction Y is disposed between the inclined surface 43 and the locking portion 33.

Figure 4:
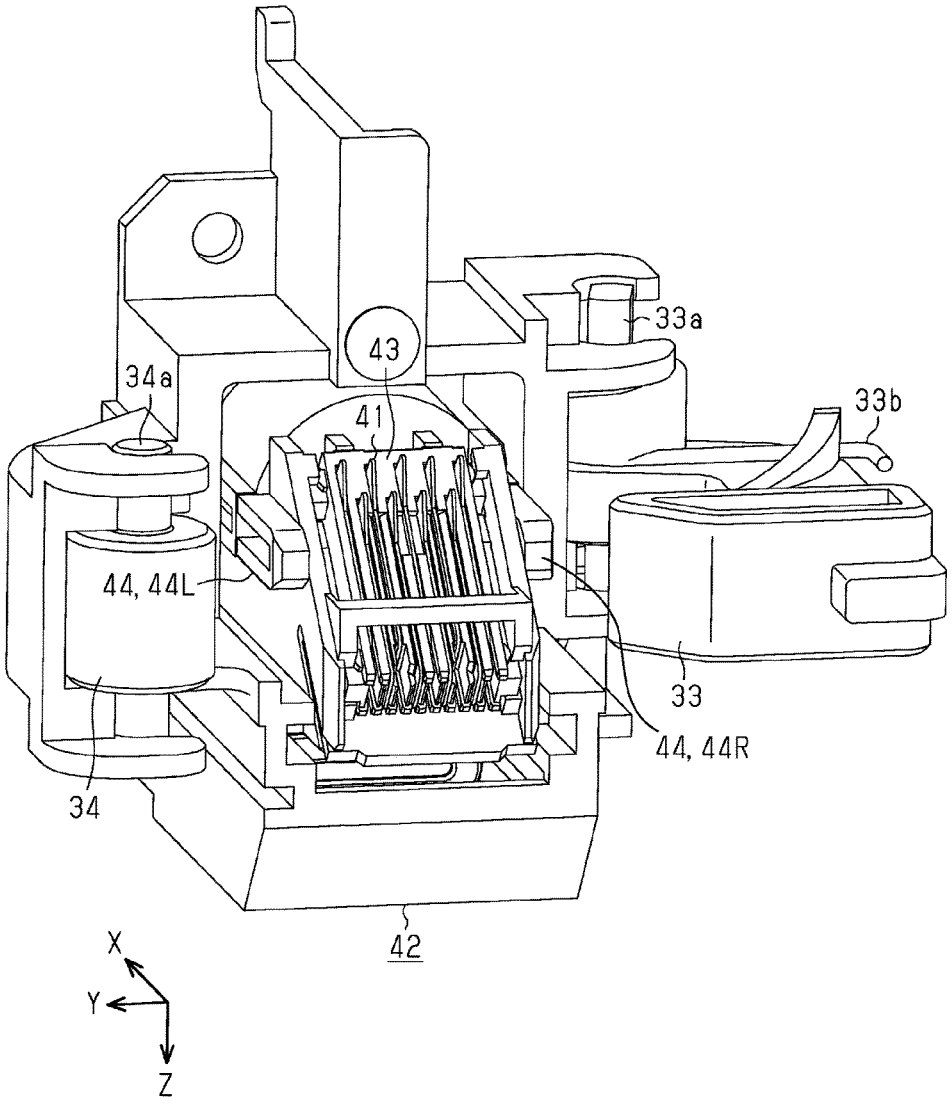
FIG. 4 is a perspective view illustrating a part of the mounting portion of FIG. 3.
Figure 5:
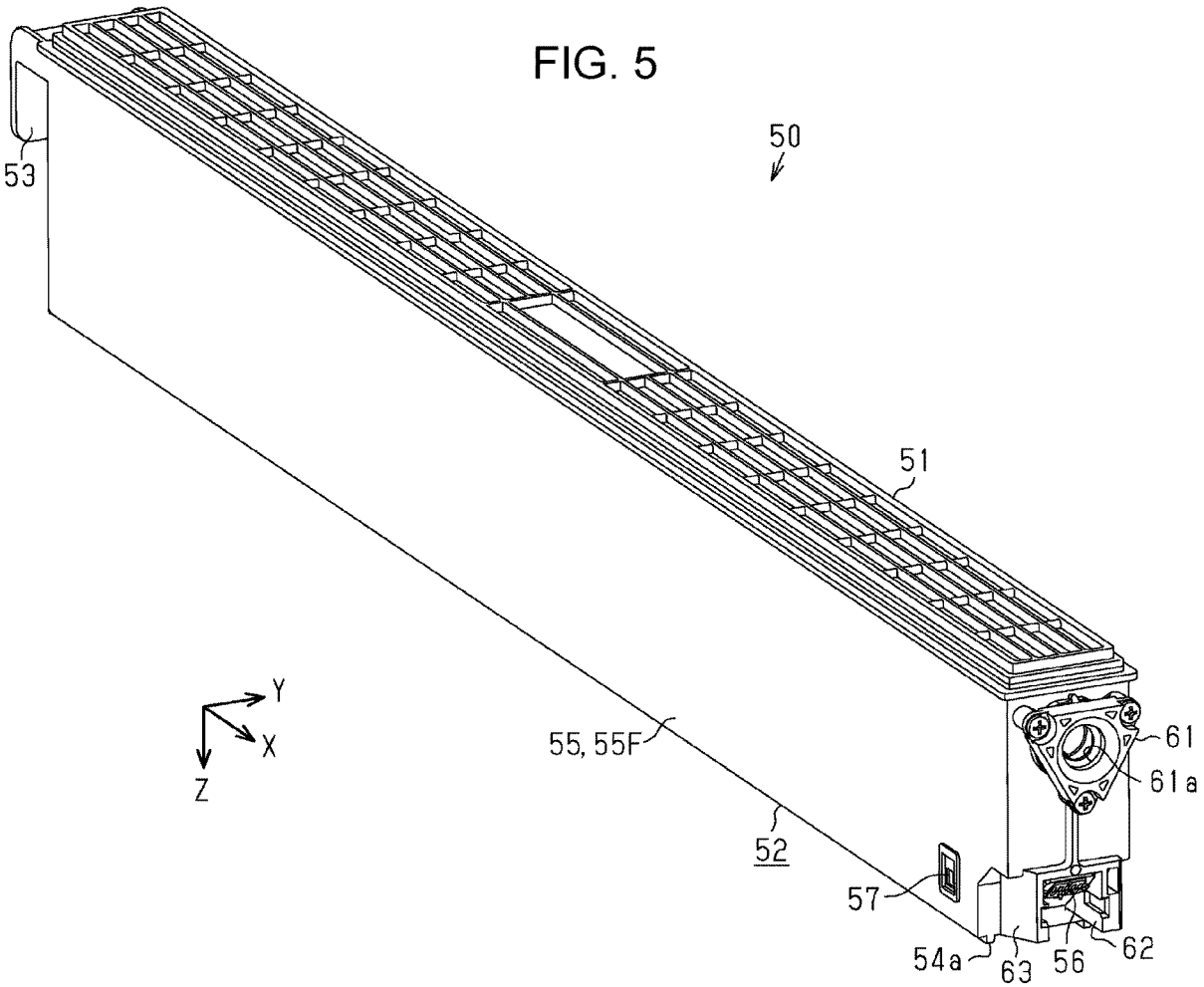
FIG. 5 is a perspective view illustrating an embodiment of the waste liquid container.
Figure 6:
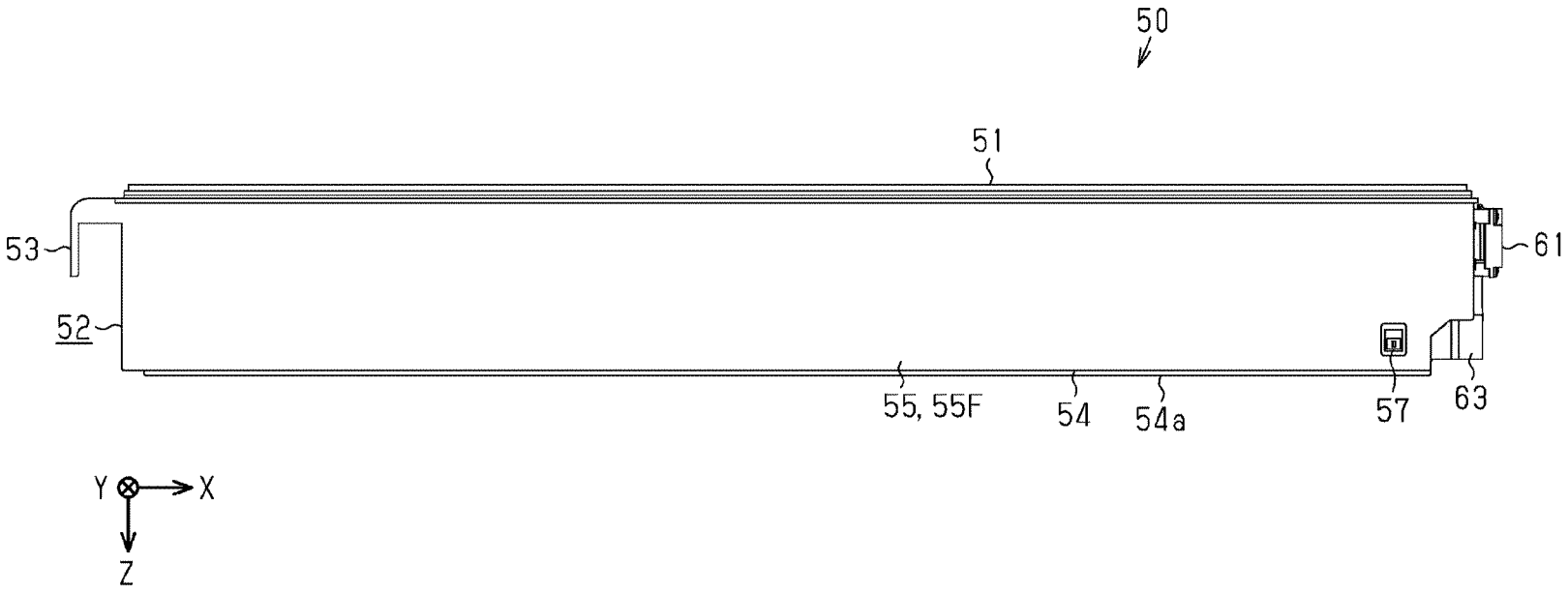
FIG. 6 is a side view of one side of the waste liquid container of FIG. 5.
Figure 7:
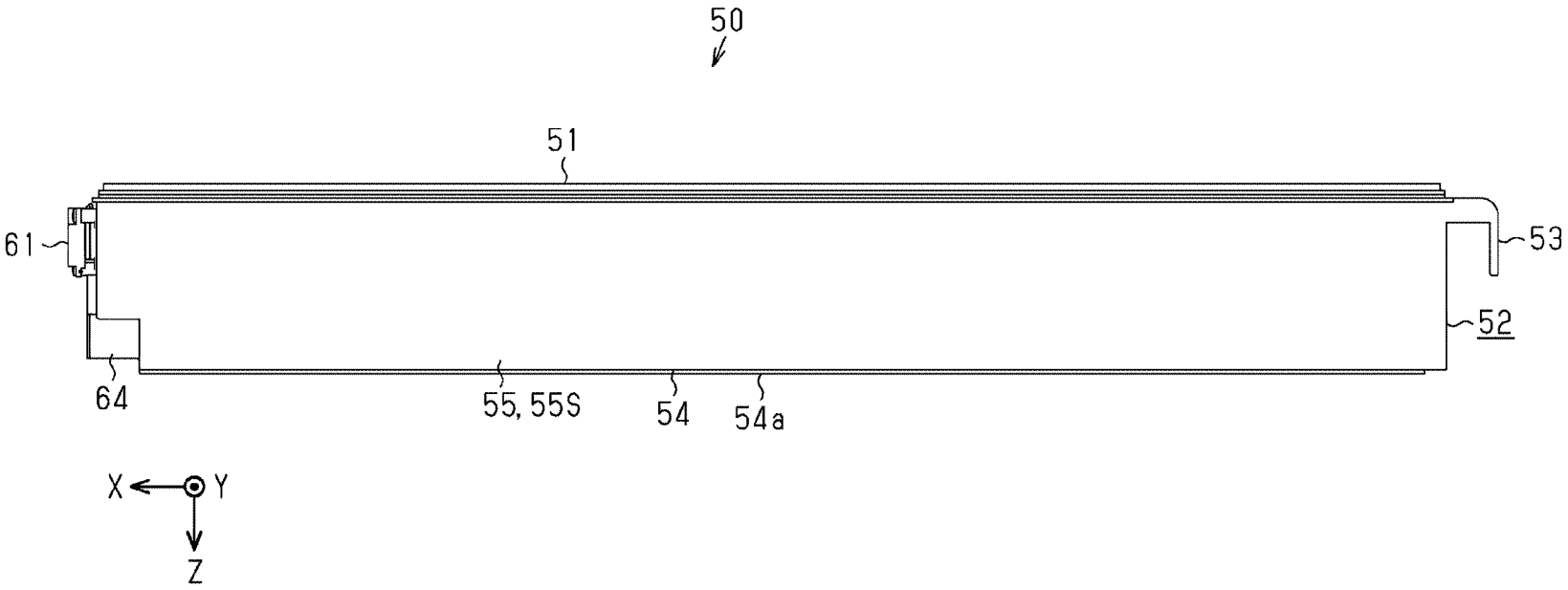
FIG. 7 is a side view of the other side of the waste liquid container of FIG. 5.

As illustrated in FIG. 4, the locking portion 33 can be rotated around a rotating axis 33*a* extending in the ejecting direction Z, and a distal end in a convex shape is energized in a direction near the inclined surface 43 by the energizing member 33*b* (for example, a torsion coil spring). In addition, the contacting roller 34 can be rotated around the rotating axis 34*a* extending in the ejecting direction Z.

Next, an embodiment of the waste liquid container 50 will be described with reference to drawings.

The waste liquid container 50 of the embodiment contains the waste liquid such as waste ink generated by a maintenance operating such as the suction cleaning in the liquid ejecting apparatus 11.

As illustrated in FIG. 5 to FIG. 9, the waste liquid container 50 is a substantially rectangular shape in which the width direction X becomes a longitudinal direction. Also, in a description of the waste liquid container 50, the ejecting direction Z indicates a direction which becomes a gravity direction at the time of being mounted on the liquid ejecting apparatus 11. The waste liquid container 50 includes a containing case 52 of a bottomed box shape in which a side thereof, which becomes an upper portion, is opened, and a lid member 51 of a plate shape which covers an opening of the containing case 52.

Figure 8:
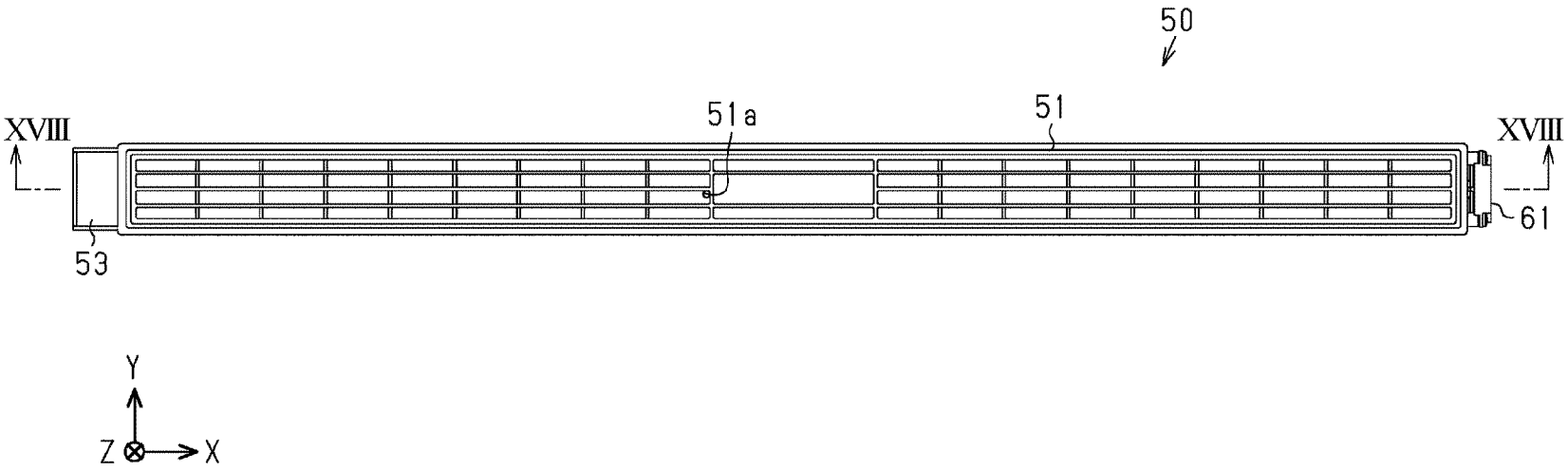
FIG. 8 is a top view of the waste liquid container of FIG. 5.
Figure 9:
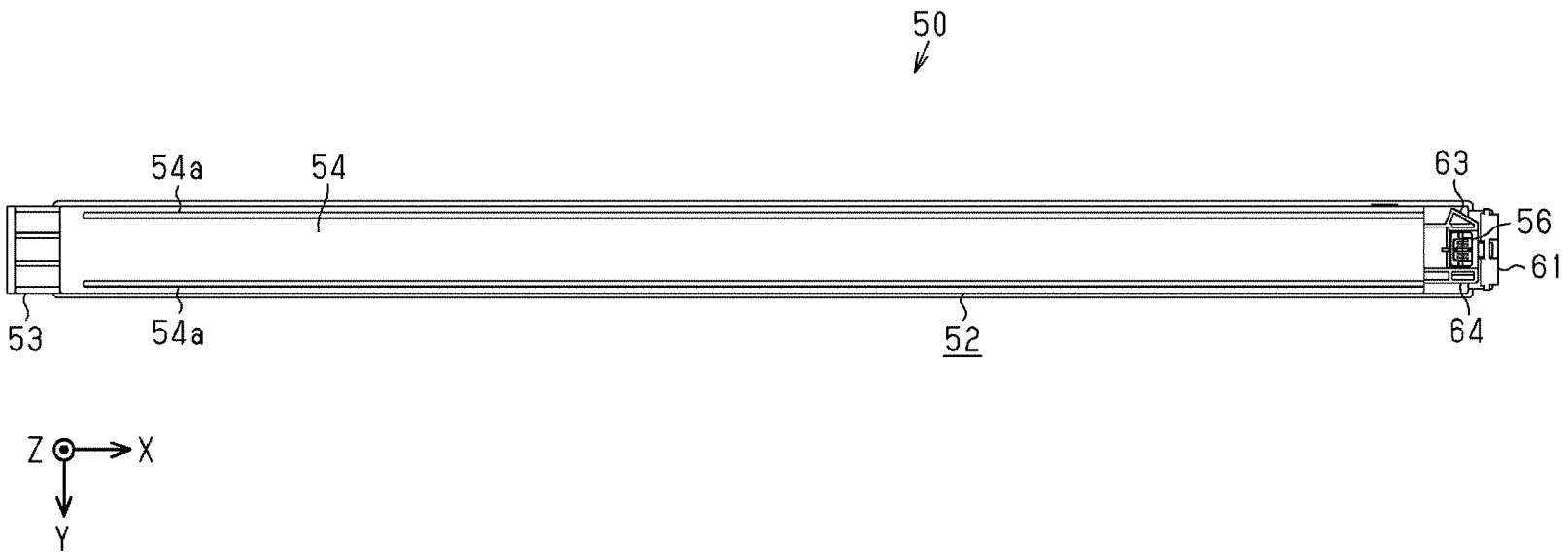
FIG. 9 is a bottom view of the waste liquid container of FIG. 5.

As illustrated in FIG. 8, it is preferable that a vent hole 51*a* is provided in the lid member 51. Accordingly, it is possible that the waste liquid is likely to be guided in the inside of the waste liquid container 50, or the guided waste liquid is prompted to be evaporated.

Figure 10:
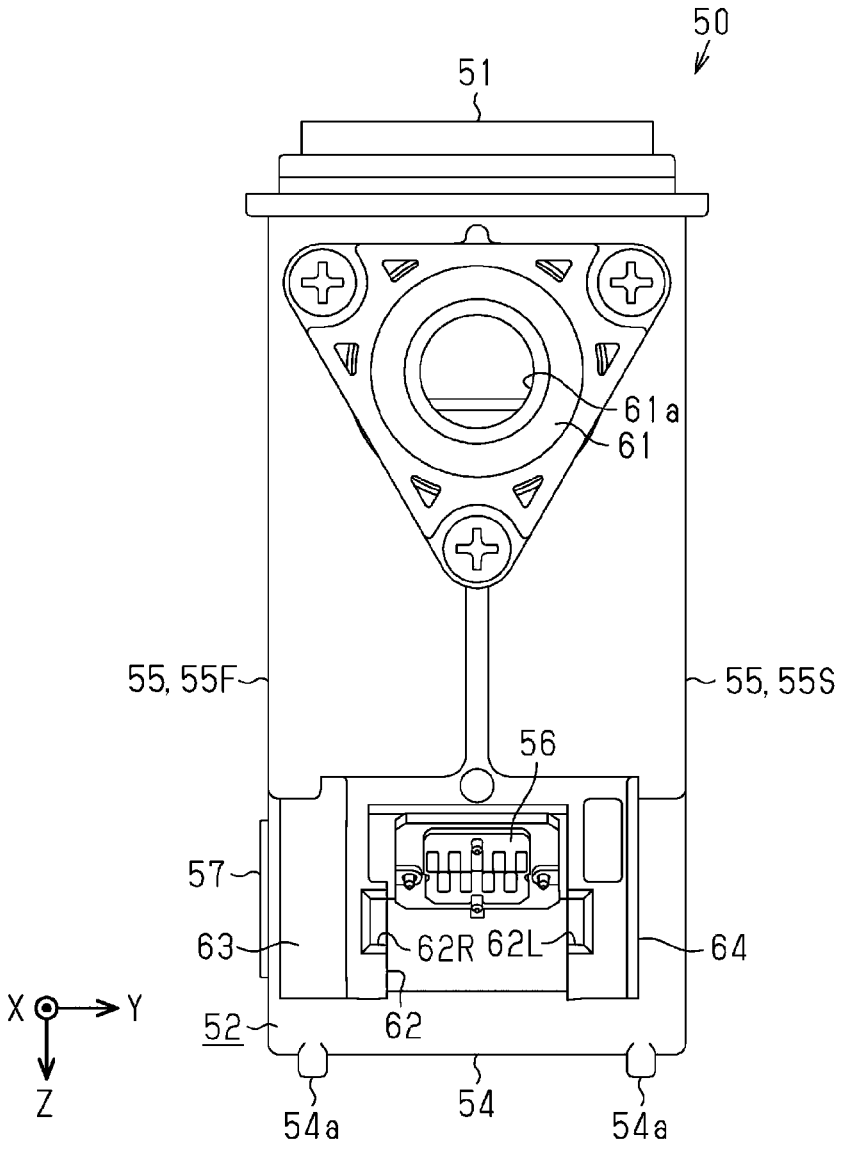
FIG. 10 is a rear view of the waste liquid container of FIG. 5.
Figure 11:
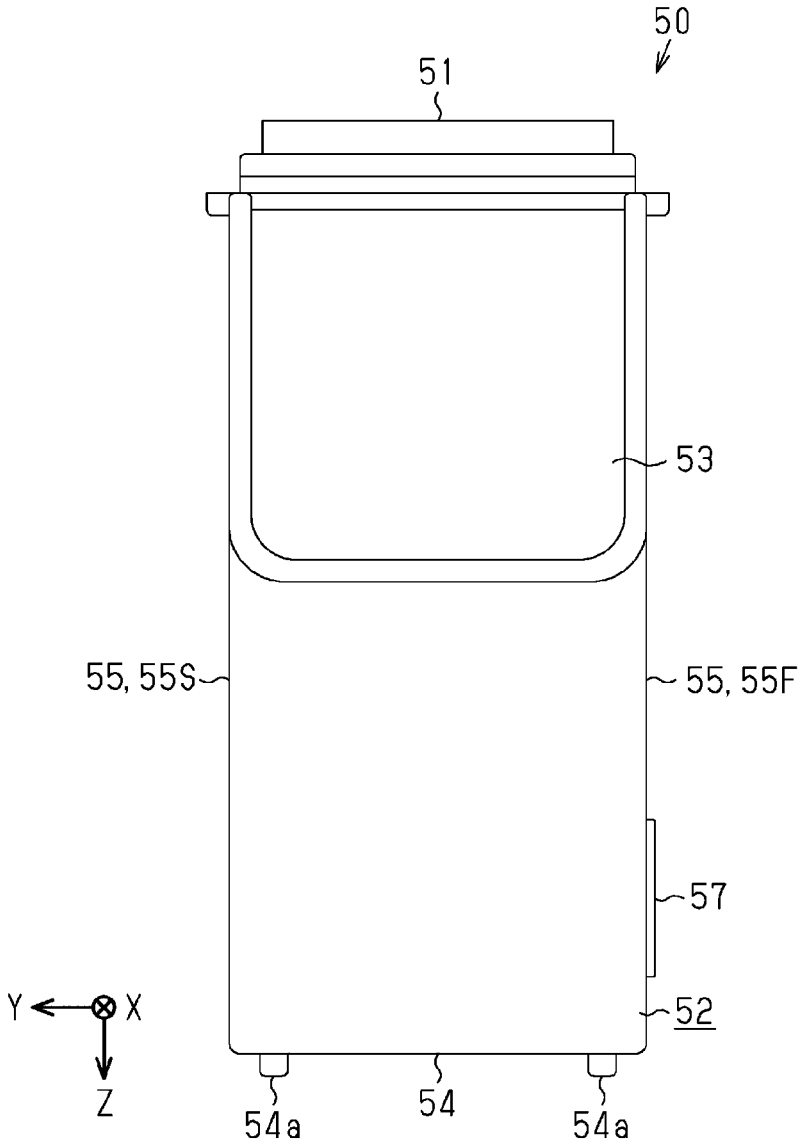
FIG. 11 is a front view of the waste liquid container of FIG. 5.
Figure 12:
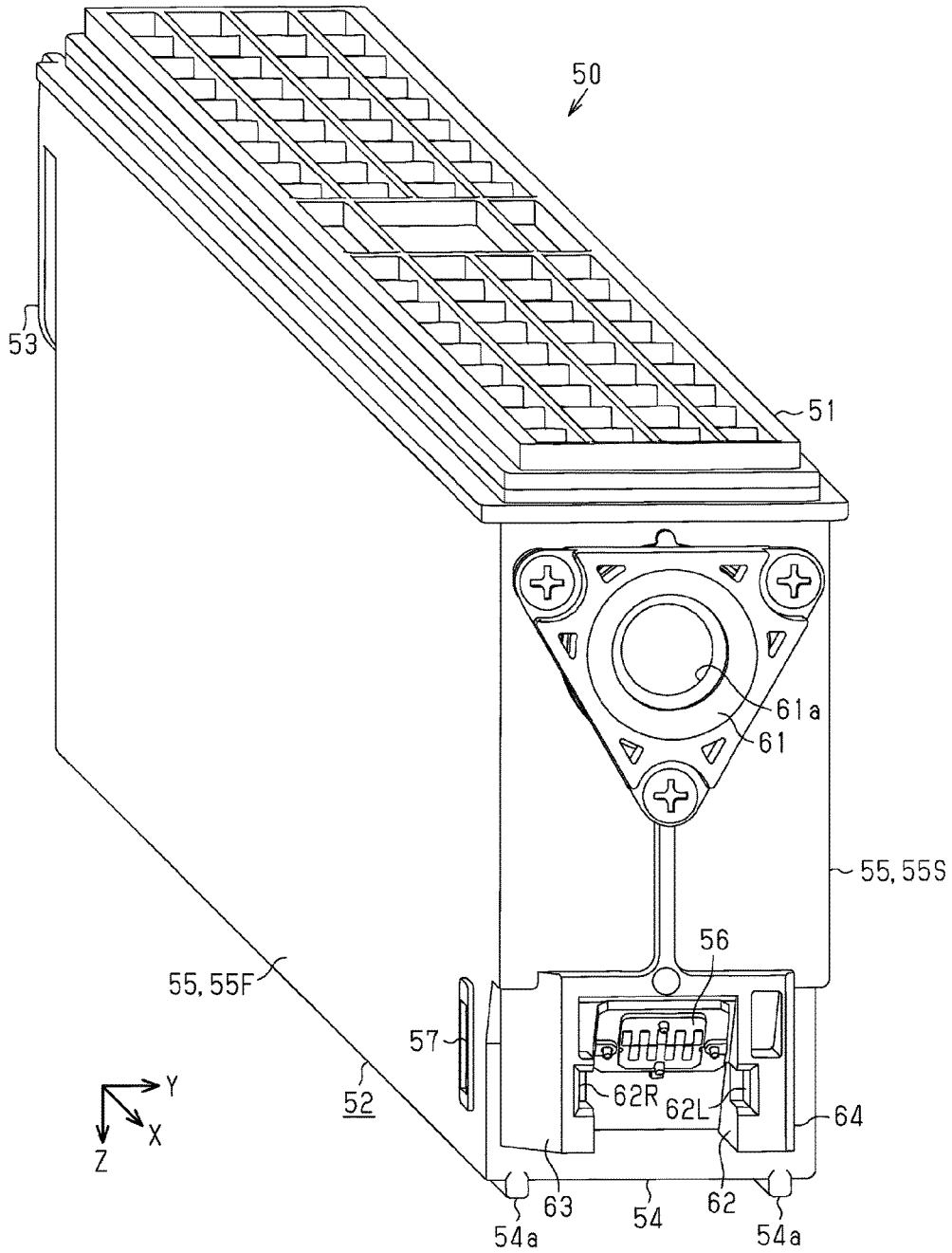
FIG. 12 is a perspective view of the waste liquid container of FIG. 5.

As illustrated in FIG. 10 to FIG. 12, a case bottom portion 54 of the containing case 52 has smaller area than a case side wall 55 (first side wall 55F and second side wall 55S) extending in the mounting direction (width direction X) intersecting with the case bottom portion 54. In addition, in the case bottom portion 54, a pair of guiding rails 54*a* extending in the mounting direction is protruded. Moreover, in the liquid ejecting apparatus 11, a guiding portion (not illustrated) engaging with guiding rail 54*a* at the time of mounting the waste liquid container 50 is provided.

As illustrated in FIG. 11, the containing case 52 includes a handle portion 53 on an end portion of one end side (front side in mounting direction) in the longitudinal direction. The handle portion 53 may be formed to be protruded from the containing case 52, and may be formed to be recessed with a recessed portion where a hand can be input.

As illustrated in FIG. 12, the containing case 52 includes a connection portion 61 which is connected to the discharging portion 31 (refer to FIG. 3) at the time of being mounted with respect to the mounting portion 30, and a container side terminal portion 56 which is electrically connected to the apparatus-side terminal portion 41 at the time of being mounted with respect to the mounting portion 30 in an end portion of the other end side (depth side in mounting direction) in the longitudinal direction. The connection portion 61 includes a connection opening 61*a* which is opened toward the mounting direction in a state of being able to be connected to the discharging portion 31. Moreover, it is preferable that the container side terminal portion 56 is disposed between two guiding rails 54*a* in the transportation direction Y.

A connection recess portion 62 in a shape of being opened in the mounting direction and the gravity direction (lower side) in a mounting state is formed on a lower side than the connection opening 61*a* in the containing case 52. The container side terminal portion 56 is disposed inside the connection recess portion 62. In addition, in the connection recess portion 62, the guiding recess portions 62L and 62R which are able to be engaged the guiding convex portion 44 (44L and 44R) (refer to FIG. 3) of the terminal holding portion 42 are provided to be recessed on a position which becomes both sides of the container side terminal portion 56 in the transportation direction Y.

The containing case 52 is provided with the engaging portion 63 and a contacting portion 64 where the locking portion 33 and the contacting roller 34 are respectively engaged at the time of being mounted with respect to the mounting portion 30 in an end portion of the other end side (depth side in mounting direction) in the longitudinal direction. It is preferable that the engaging portion 63 and the contacting portion 64 are disposed on a position in parallel with the container side terminal portion 56 in a direction (for example, transportation direction intersecting with vertical direction and mounting direction) intersecting with a vertical direction. In addition, the engaging portion 63 and the contacting portion 64 are not necessary to be disposed on the end portion of the mounting direction, but are preferably disposed near an upper side of a depth side of the waste liquid container 50 in the mounting direction.

The containing case 52 is provided with the reflecting portion 57 which is capable of reflecting emission light of the light emitting portion 35*a* of the optical sensor 35 toward the light receiving portion 35*b* on the first side wall 55F of any one side of the case side wall 55, at the time of being mounted on the mounting portion 30. It is preferable that the reflecting portion 57 is disposed on a position parallel with the engaging portion 63 in a direction (for example, transportation direction intersecting with both the vertical direction and the mounting direction) intersecting with the vertical direction. In addition, it is preferable that the reflecting portion 57 is disposed near an upper side of on a depth side of the first side wall 55F in the mounting direction.

Figure 13:
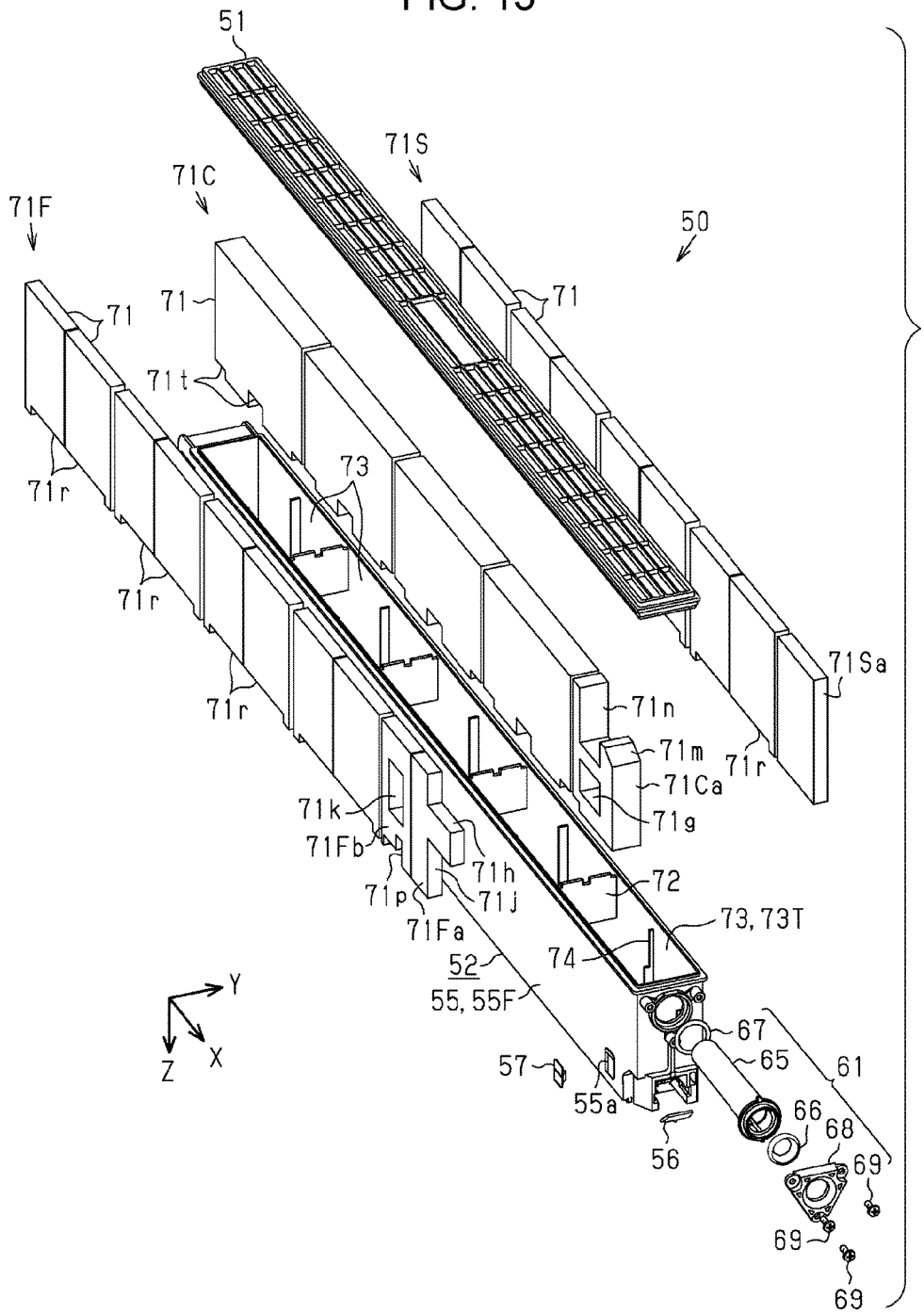
FIG. 13 is an exploded perspective view of the waste liquid container of FIG. 5.

As illustrated in FIG. 13, the containing case 52 is a bottomed box shape which is opened toward an upper side in a mounting state, and the waste liquid container 50 includes a plurality of waste liquid absorbing members 71 contained in the containing case 52. The waste liquid absorbing member 71 is formed of, for example, a plate shape porous body, and is capable of absorbing and holding the waste liquid by a capillary force of holes.

The connection portion 61 includes an inserting pipe portion 65 of a cylindrical shape, seal members 66 and 67, and a fixing member 68, and the inserting pipe portion 65 is fixed to the containing case 52 when the fixing member 68 is screwed to the containing case 52 by a screw 69, in a state in which the seal members 66 and 67 are respectively interposed between the fixing member 68 and the containing case 52.

An inside the containing case 52 is partitioned to a plurality (for example, five) of waste liquid containing chambers 73 which are capable of containing the waste liquid by a plurality of partition plates 72 which is disposed with a predetermined void in the longitudinal direction. Here, if the waste liquid containing chamber 73 of a most depth side in the mounting direction is set to the waste liquid containing chamber 73T, the inserting pipe portion 65 in a pipe shape is contained inside the waste liquid containing chamber 73T. In addition, in the containing case 52, an opening for detecting 55*a* into which the reflecting portion 57 is put is formed on the first side wall 55F which forms the waste liquid containing chamber 73T.

The partition plate 72 is provided near an opening of the containing case 52, and each of the waste liquid containing chambers 73 communicates with each other in a bottom portion side of the containing case 52. In addition, a plate-shape protrusion portion 74 is provided in a shape of being protruded from the case side wall 55 on each of the waste liquid containing chambers 73 of the containing case 52.

Figure 14:
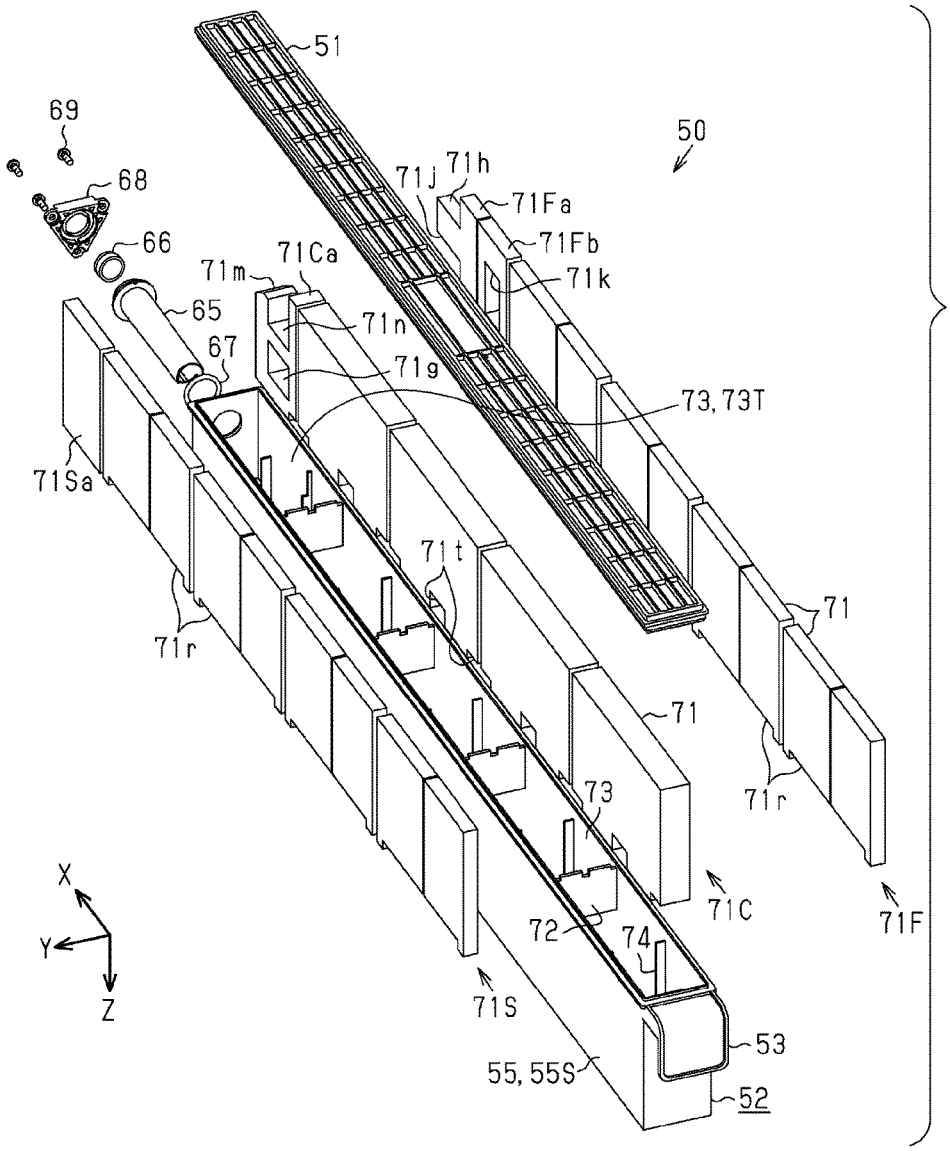
FIG. 14 is an exploded perspective view of the waste liquid container of FIG. 5.

As illustrated in FIG. 14, a plurality of (for example, three) the waste liquid absorbing members 71 which is in parallel in the transportation direction Y are contained as one set in each of the waste liquid containing chamber 73. Among the waste liquid absorbing members 71 of one set, the waste liquid absorbing member 71 of a first side wall 55F side is set to a waste liquid absorbing member 71F, the waste liquid absorbing member 71 of a second side wall 55S side is set to a waste liquid absorbing member 71S, and the waste liquid absorbing member 71 of an intermediate position is set to a waste liquid absorbing member 71C. The waste liquid absorbing member 71C has a width (length in transportation direction Y) same as that of the inserting pipe portion 65, and in the embodiment, the width is wider than both of the waste liquid absorbing members 71F and 71S.

In the waste liquid absorbing member 71F, members which are contained in the waste liquid containing chamber 73T is set to waste liquid absorbing members 71Fa and 71Fb, and in the waste liquid absorbing members 71C and 71S, members which are contained in the waste liquid containing chamber 73T are set to waste liquid absorbing members 71Ca and 71Sa. In the waste liquid absorbing member 71Ca, notches 71*n* and 71*m* are formed in a position corresponding to an end portion of the inserting pipe portion 65, and a through hole 71*g* is formed on a lower side of the notch 71*n*.

As illustrated in FIG. 13 and FIG. 14, in the mounting direction (the width direction X), lengths of the waste liquid absorbing members 71Ca and 71Sa are set to be shorter than the waste liquid containing chamber 73T, and the waste liquid absorbing members 71Ca and 71Sa are disposed near a front side of the mounting direction so that a void is generated on a depth side of the waste liquid containing chamber 73T in the mounting direction. In addition, in the waste liquid absorbing member 71Fa, the notches 71*h* and 71*j* are respectively formed on positions which become an upper side and a lower side of the inserting pipe portion 65 in the vertical direction.

Figure 15:
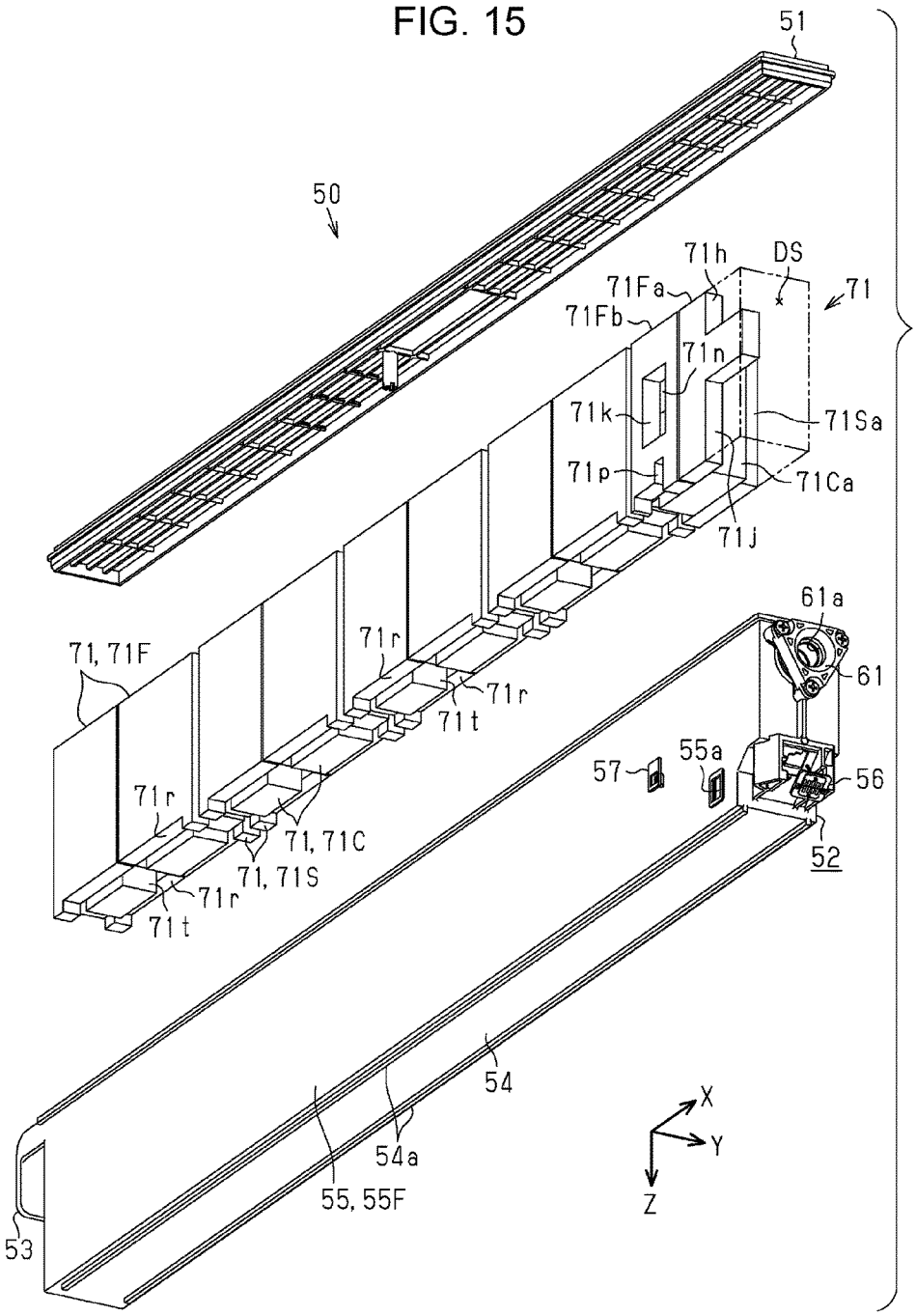
FIG. 15 is an exploded perspective view of the waste liquid container of FIG. 5.

As illustrated in FIG. 14 and FIG. 15, in the waste liquid containing chamber 73T, the notch 71*j* forms a detecting space DS (refer to FIG. 15) on a vicinity of the reflecting portion 57 with the void formed on the depth side of the mounting direction by shortening the lengths of the waste liquid absorbing members 71Ca and 71Sa. In addition, a through hole 71*k* which communicates with the adjacent notch 71*n* (refer to FIG. 14) of the waste liquid absorbing member 71Ca and the through hole 71*g* (refer to FIG. 14), and the notch 71*p* (refer to FIG. 15) communicating with the through hole 71*g* are formed in the waste liquid absorbing member 71Fb.

Figure 16:
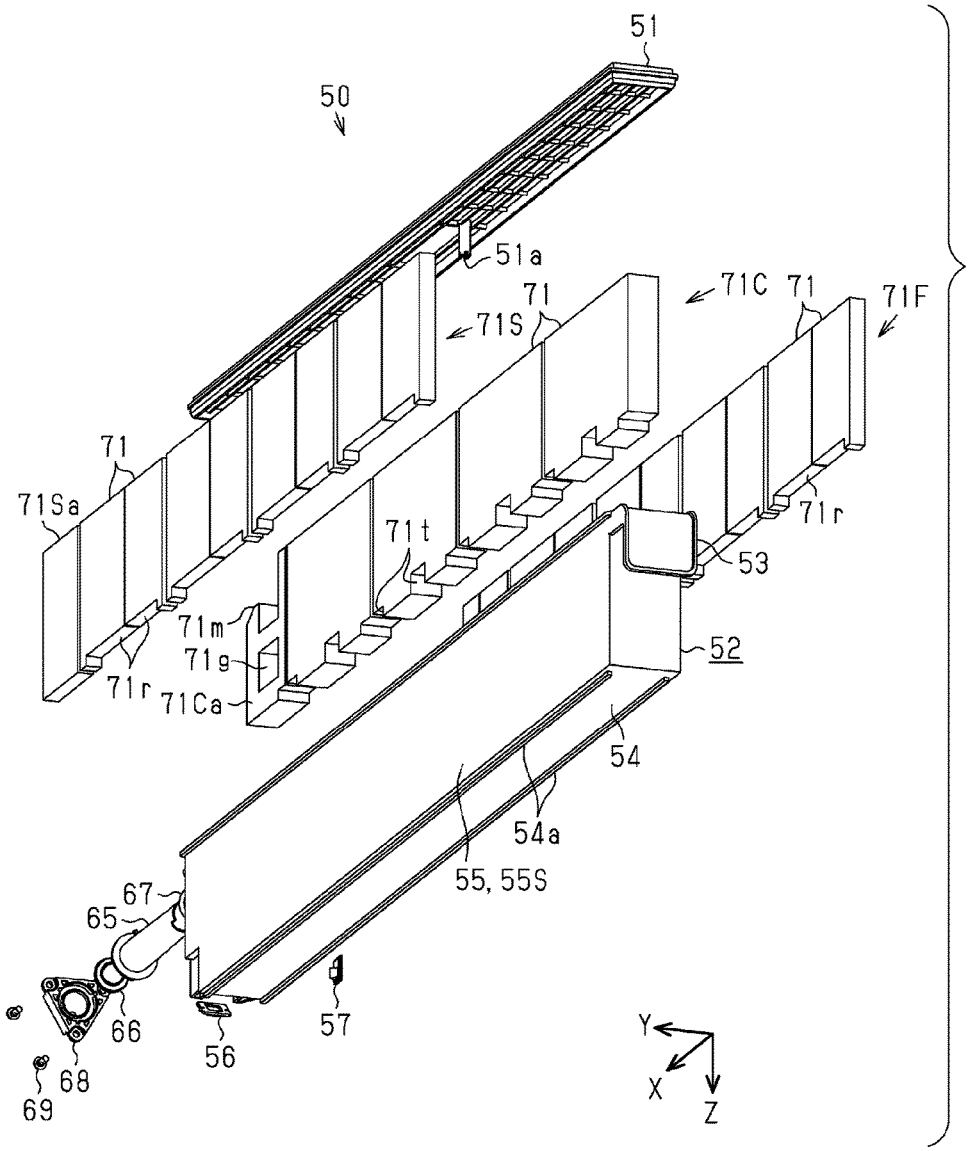
FIG. 16 is an exploded perspective view of the waste liquid container of FIG. 5.

As illustrated in FIG. 15 and FIG. 16, except the waste liquid absorbing members 71Fa and 71Sa, notches 71*r*, 71*t*, and 71*r* for forming a void (space) between the members and the case bottom portion 54 are respectively formed on bottom portions (distal end portion of ejecting direction Z) of the waste liquid absorbing members 71F, 71C, and 71S.

Figure 17:
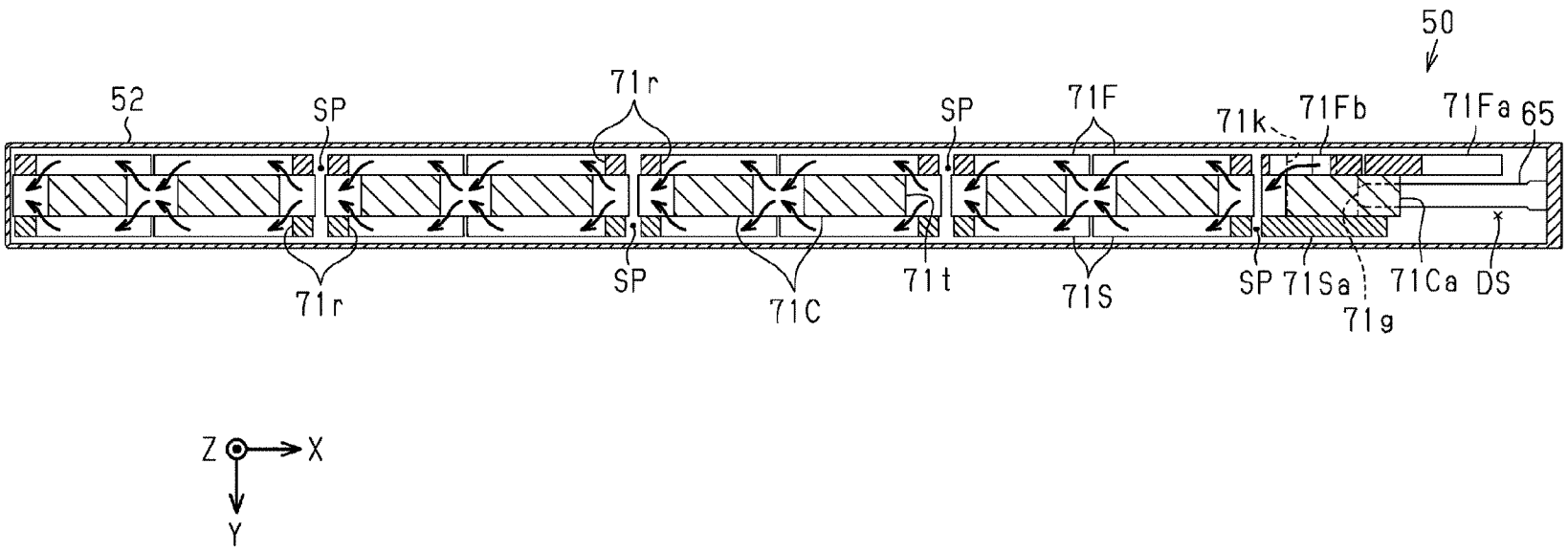
FIG. 17 is a sectional view illustrating an induction flow passage of the waste liquid container of FIG. 5.

As illustrated in FIG. 17, the notches 71*r* which are formed on the bottom portions of the waste liquid absorbing member 71F and the waste liquid absorbing member 71S are arranged side by side in the transportation direction Y to include the waste liquid absorbing member 71C therebetween, and are set to be positioned so that an end portion thereof in the width direction X is partially overlapped with and deviated from the notch 71*t* formed on the bottom portion of the waste liquid absorbing member 71C. As a result, a space formed by the notch 71*r* and a space formed by the notch 71*t* are communicated with each other as illustrated by an arrow in FIG. 17.

Figure 18:
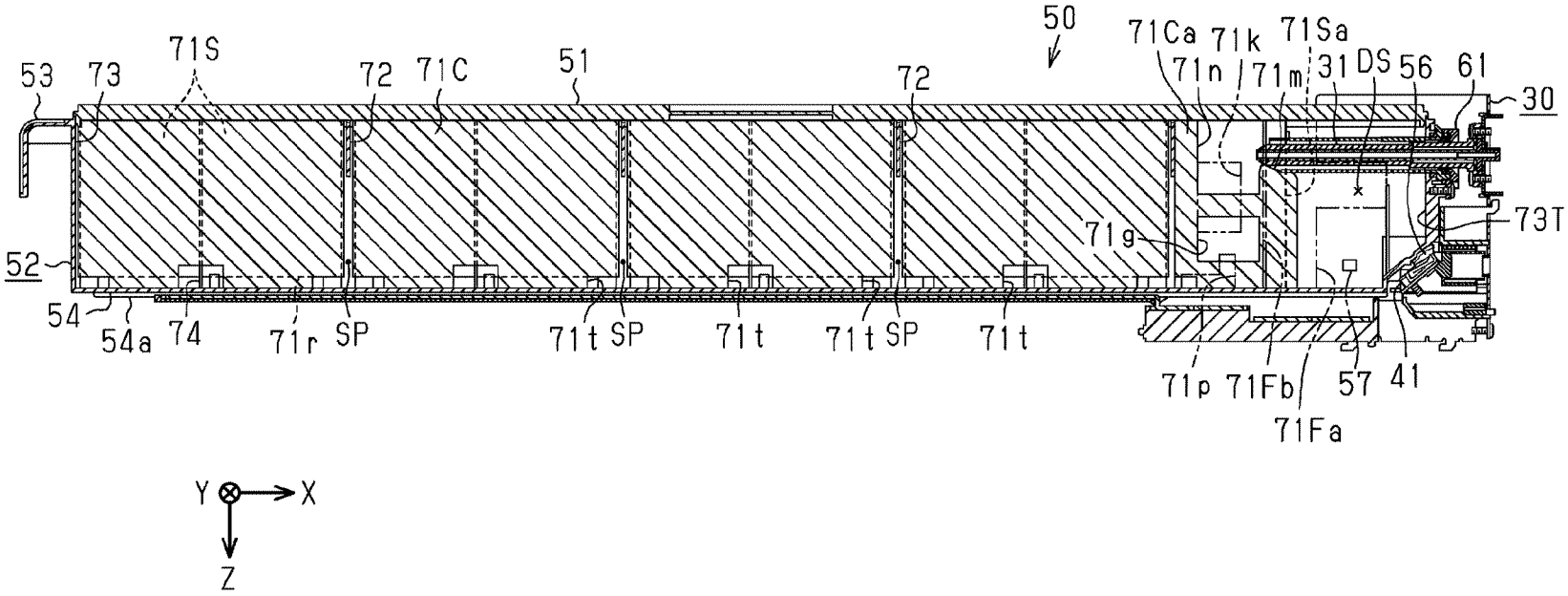
FIG. 18 is a sectional view taken along line XVIII-XVIII of FIG. 8.

As illustrated in FIG. 18, a notch 71*m* of the waste liquid absorbing member 71Ca is disposed on a position supporting a distal end of the inserting pipe portion 65, and a notch 71*n* of the waste liquid absorbing member 71Ca is formed to be a space where a waste liquid introduced through the connection portion 61 flows into.

In addition, the plate-shape protrusion portion 74 of the containing case 52 is disposed between the waste liquid absorbing members 71F and 71S which are arranged in the width direction X in each waste liquid containing chamber 73. Also, movement along the width direction X of the waste liquid absorbing member 71 is controlled by the partition plate 72 and the plate-shape protrusion portion 74. In addition, a void SP between the waste liquid absorbing member 71 contained in the waste liquid containing chamber 73 in contact with the width direction X is formed on a lower side of the partition plate 72 in the containing case 52. The void SP communicates with a space formed by the notch 71*t* of the waste liquid absorbing member 71C.

Also, the waste liquid, which is introduced to a space formed by the notch 71*n* inside the containing case 52 through the connection portion 61, flows into the through hole 71*g* through the through hole 71*k*, further, flows into a space formed by the notches 71*r* and 71*t* through the notch 71*p*, and flows in the bottom portion of the waste liquid containing chamber 73 along these spaces. Here, in the waste liquid containing chamber 73, spaces formed by the notch 71*n*, the through hole 71*k*, the through hole 71*g*, the notch 71*p*, and the notches 71*r* and 71*t* refer to as an induction flow passage (an induction flow passage is illustrated by an arrow in FIG. 17) of the waste liquid. The induction flow passage is in contact with the entirety of the waste liquid absorbing member 71 inside the waste liquid container 50. Therefore, the waste liquid introduced in the waste liquid containing chamber 73 is not absorbed unevenly to the waste liquid absorbing member 71 of a part near an introducing portion, and is efficiently absorbed by the entire waste liquid absorbing member 71 in a process of being flowed in the induction flow passage.

In addition, as illustrated in FIG. 17, in the induction flow passage, a space formed by the notch 71*t*, communicates with the void SP extending in the gravity direction. Therefore, if an amount of the waste liquid flowing in the induction flow passage, a part of the waste liquid is absorbed to the waste liquid absorbing member 71 while flowing in a vertical upper direction through the void SP.

Moreover, if a capacity of the induction flow passage is small, when a large amount of the waste liquid is introduced into the waste liquid container 50, absorbing by the waste liquid absorbing member 71 does not keep up with a flowing speed of the waste liquid, and there is a concern that the introduced waste liquid is overflow from the connection opening 61*a*. For this reason, it is preferable that the capacity of the induction flow passage is set to be more than a maximum amount of the waste liquid discharged by one time suction cleaning. Meanwhile, if the capacity of the induction flow passage is enlarged too much, a capacity for disposing the waste liquid absorbing member 71 is reduced, and thus a capacity where the waste liquid can be absorbed and held is reduced. Therefore, it is preferable that the capacity of the induction flow passage is set to be equal to a maximum amount of the waste liquid which is discharged by one time suction cleaning.

Figure 19:
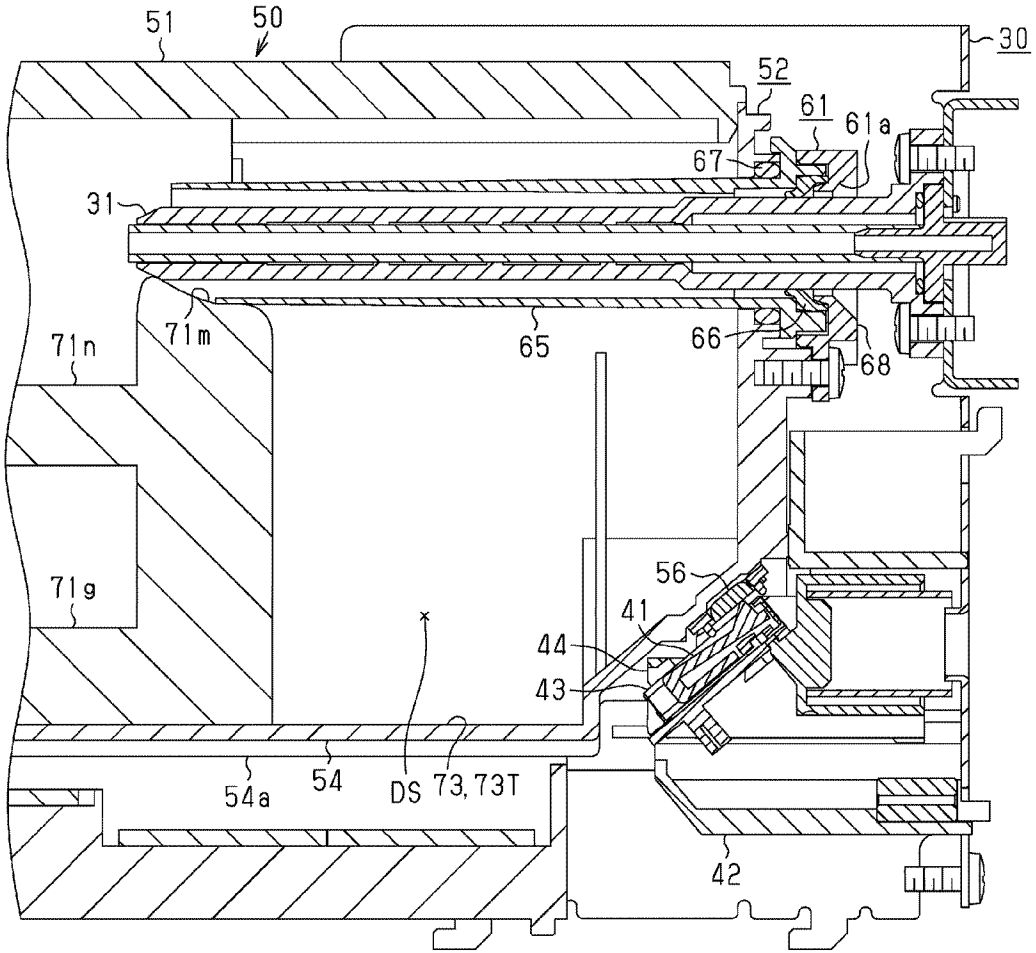
FIG. 19 is a partial enlarged view of the sectional view illustrated in FIG. 18.

As illustrated in FIG. 19, the container side terminal portion 56 is disposed on a lower side than the connection opening 61*a* in a shape inclined with respect to the mounting direction (width direction X), in a state of being mounted with respect to the mounting portion 30 of the waste liquid container 50. Specifically, the container side terminal portion 56 is inclined so that a depth side is far from the case bottom portion 54 than a front side of the mounting direction in the gravity direction. With respect that, the apparatus-side terminal portion 41 is held so as to face the container side terminal portion 56 on the inclined surface 43 which is formed so that a depth side (base end side) is higher than a front side (distal end side) of the mounting direction.

Next, a mounting operation with respect to the mounting portion 30 of the waste liquid container 50 and an action of the waste liquid container 50 will be described.

Figure 20:
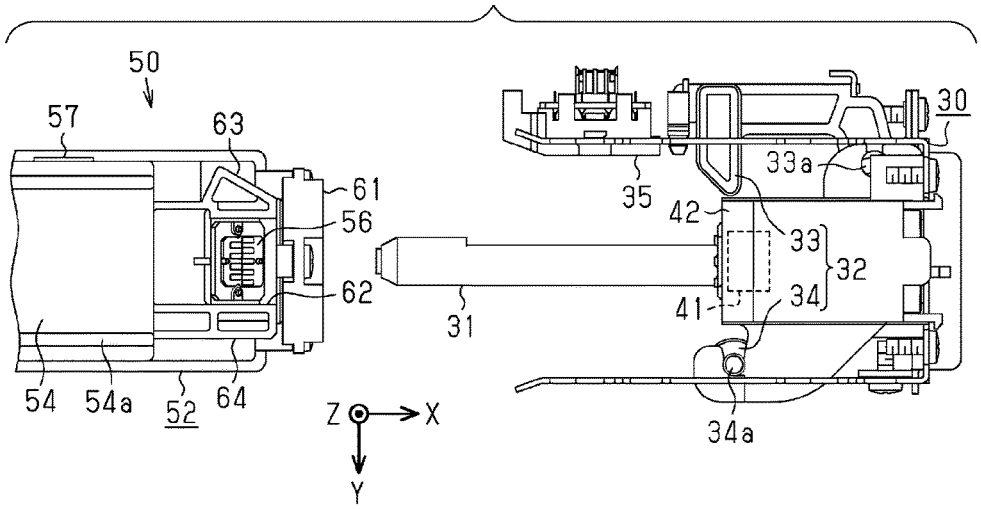
FIG. 20 is a bottom view illustrating a state before the waste liquid container of FIG. 5 is mounted on the mounting portion.

As illustrated in FIG. 20, if the waste liquid container 50 is moved in the mounting direction with respect to the mounting portion 30, the discharging portion 31 is connected to the connection portion 61 of the waste liquid container 50, and the locking portion 33 and the contacting roller 34 are respectively engaged with the engaging portion 63 and the contacting portion 64.

Figure 21:
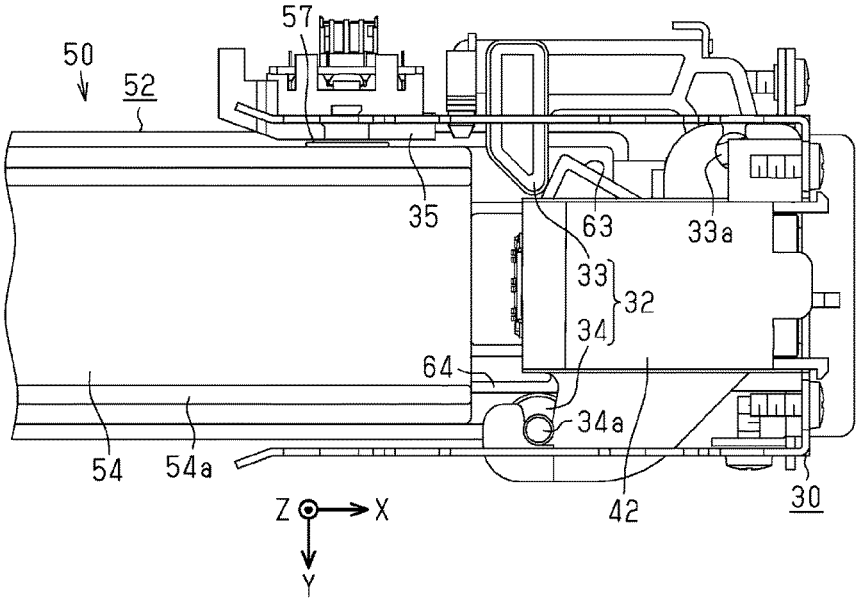
FIG. 21 is a bottom view illustrating a state after the waste liquid container of FIG. 5 is mounted on the mounting portion.

Also, as illustrated in FIG. 21, since a distal end of the locking portion 33 gets held up the engaging portion 63 of a convex shape, a position in the mounting direction (the width direction X) of the waste liquid container 50 is determined, and further, when the locking portion 33 which is biased presses the contacting portion 64 of the waste liquid container 50 to the contacting roller 34, a position in the transportation direction Y of the waste liquid container 50 is determined. At this time, the reflecting portion 57 of the waste liquid container 50 is disposed on a position facing the optical sensor 35.

In addition, at this time, the container side terminal portion 56 is moved to the mounting direction (width direction X) in a shape of being slide and ridden up the apparatus-side terminal portion 41 on the inclined surface 43, the container side terminal portion 56 and the apparatus-side terminal portion 41 are electrically connected to each other. Moreover, even when the container side terminal portion 56 is slide and ridden up the apparatus-side terminal portion 41 on the inclined surface 43, and thus attaching material such as dust is attached to the container side terminal portion 56 or the apparatus-side terminal portion 41, an electrical contact point is secured by pressing the attaching material.

In addition, when the container side terminal portion 56 is in contact with the apparatus-side terminal portion 41, the container side terminal portion 56 is accurately positioned with respect to the apparatus-side terminal portion 41 by respectively engaging the guiding convex portions 44L and 44R of the terminal holding portion 42 with the guiding recess portions 62L and 62R of the waste liquid container 50.

Moreover, if the waste liquid container 50 becomes full, the containing case 52 is expanded and a position or a posture of the container side terminal portion 56 is changed, and thus there is a concern that a contacting defect with respect to the apparatus-side terminal portion 41 is generated. At this point, the apparatus-side terminal portion 41 is disposed between the engaging portion 63 and the contacting portion 64 in the transportation direction Y, and the engaging portion 63 is biased in the locking portion 33, and thus a displace of the container side terminal portion 56 due to expendedly deforming of the containing case 52 is suppressed.

Figure 22:
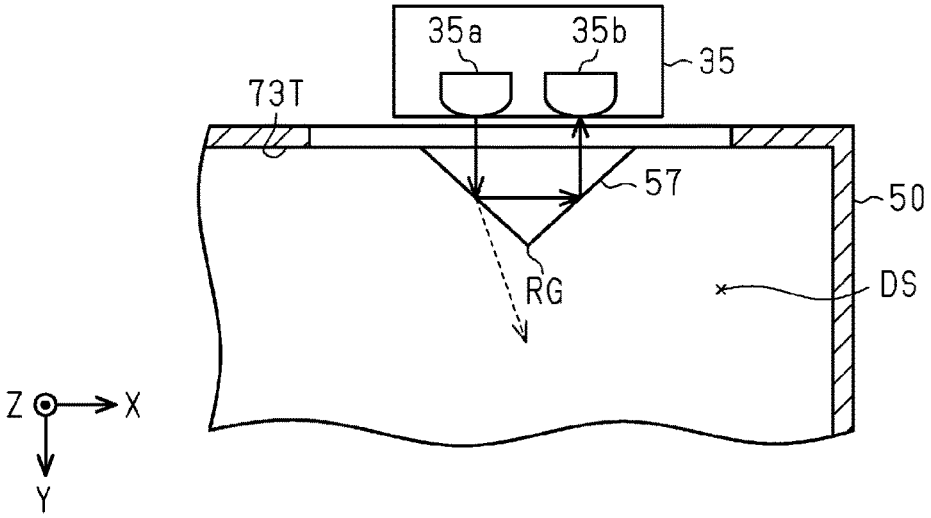
FIG. 22 is a schematic view describing an action of a reflecting portion which is provided in the waste liquid container of FIG. 5.

As illustrated in FIG. 22, it is preferable that the reflecting portion 57 is, for example, a triangular prism (critical angle prism) in which a reflection state of light is changed in accordance with present or absence of waste liquid inside the waste liquid container 50. In this case, the reflecting portion 57 is disposed so that a second surface of the triangular prism is protruded to the detecting space DS formed inside the waste liquid containing chamber 73T of the waste liquid container 50, and a remained first surface is exposed to the outside of the waste liquid container 50.

Also, when the light emitted from the light emitting portion 35*a* of the optical sensor 35 is incident on a triangular prism from a surface exposed outside the waste liquid container 50, if the waste liquid does not exist in a region in contact with the triangular prism inside the detecting space DS, as illustrated by an arrow of a solid line in FIG. 22, the incident light is reflected the other two surfaces, and the light receiving portion 35*b* receives the incident light. With respect that, if the waste liquid fills in a region in contact with the triangular prism inside the detecting space DS, as illustrated by a broken line in FIG. 22, the incident light is transmitted through the triangular prism without being reflected, and thus the light receiving portion 35*b* does not receive the incident light.

As illustrated in FIG. 18, the detecting space DS is separated by the induction flow passage and the void SP to which the waste liquid is initially introduced, and the waste liquid absorbing member 71 in the waste liquid containing chamber 73T. For this reason, after the waste liquid is absorbed in the waste liquid absorbing member 71 in contact with the induction flow passage and the void SP, waste liquid, which is not absorbed in the waste liquid absorbing member 71 and overflows, flows into the detecting space DS.

As a result, when the waste liquid flows into the detecting space DS and an amount of light of reflected light which is received in the light receiving portion 35*b* of the optical sensor 35 is reduced, it is detected that a remaining capacity of the waste liquid able to being contained in the waste liquid container 50 is disappear or remained a few. In a case in which such a remained capacity is detected to be shortage, based on a detection signal of the optical sensor 35, the controller 100 detects a fill-up state (remaining capacity shortage) of the waste liquid container 50.

Also, if a space to which the waste liquid container 50 is initially introduced is set to the detecting space DS, absorbing of the waste liquid in the waste liquid absorbing member 71 is not necessary to wait and detect, and thus it takes time until detecting. At this point, after the waste liquid introduced in the waste liquid container 50 flows the induction flow passage and is absorbed in the waste liquid absorbing member 71, if the waste liquid overflows in the detecting space DS, the detection of remaining capacity shortage until the waste liquid flowing into the detecting space DS is absorbed in the waste liquid absorbing member 71 may not be waited, and thus the detection of remaining capacity shortage can be promptly performed.

In a case in which the controller 100 detects remaining capacity shortage of the waste liquid container 50, a user can be informed of exchanging the waste liquid container 50, for example, by displaying an error on the operating portion 29 (refer to FIG. 2), or the like which is made of a liquid crystal panel by the controller 100. Moreover, if the reflecting portion 57 is disposed near an upper side of the detecting space DS, disappearing of a remained amount can be detected, and if the reflecting portion 57 is disposed near a lower side of the detecting space DS, reducing of the remained amount can be detected.

In addition, in a case in which the waste liquid container 50 is not sufficiently moved in the mounting direction, and is not appropriately connected to the mounting portion 30, light emitted from the optical sensor 35 is not appropriately reflected, and thus the light receiving portion 35*b* does not receive the light, and the optical sensor 35 outputs a detection signal (error signal). Accordingly, the controller 100 informs a user about confirmation of mounting the waste liquid container 50, or the like through a liquid crystal panel, or the like, and a risk of waste liquid leaking to the waste liquid container 50 which is not appropriately connected can be reduced.

Here, the reflecting portion 57 is provided on an end surface of a depth side in the mounting direction of the waste liquid container 50, and can be set so that the light emitting portion 35*a* of the optical sensor 35 emits light in an extracting direction-X. However, in this case, the waste liquid container 50 is not sufficiently moved in the mounting direction, and even when the waste liquid container 50 is not appropriately connected to the mounting portion 30, light applied to an end surface of a depth side of the waste liquid container 50 is reflected to the reflecting portion 57, and thus the light receiving portion 35*b* receives the reflected light. For this reason, the optical sensor 35 does not detect that the waste liquid container 50 is not appropriately mounted.

Therefore, in a case in which mounting of the waste liquid container 50 is detected by the optical sensor 35, the reflecting portion 57 is provided on a side wall (case side wall 55) extending in the mounting direction of the waste liquid container 50, and it is preferable that the optical sensor 35 is set to emit the light in a direction intersecting with the side wall.

Moreover, when the controller 100 detects an electrical connection of the container side terminal portion 56 and the apparatus-side terminal portion 41, it can be detected that whether or not the waste liquid container 50 is appropriately mounted. However, in a case in which the container side terminal portion 56 and the apparatus-side terminal portion 41 have a predetermined width in plan, and both of them face and in contact with each other in a state of being inclined so as to be intersect with each other in the mounting direction, if a part of them comes into contact with each other, even when the discharging portion 31 is not sufficiently inserted to the connection opening 61*a*, the controller 100 detects the connection.

However, even when the discharging portion 31 is not sufficiently inserted to the connection opening 61*a*, a distal end opening of the discharging portion 31 does not reach the notch 71*m* forming the induction flow passage, and is disposed inside the detecting space DS. In this case, although an absorbing amount due to the waste liquid absorbing member 71 inside the waste liquid container 50 is remained, the detecting space DS is filled with the waste liquid, and there is a concern that the waste liquid container 50 is determined to be remaining capacity shortage based on the detection signal of the optical sensor 35. For this reason, particularly, in the waste liquid container 50, in a case in which the induction flow passage and the detecting space DS are formed not to be communicated with each other, a space to which the waste liquid is introduced is changed by inserting the discharging portion 31, it is preferable that a mounting state of the waste liquid container 50 is accurately detected.

Figure 23:
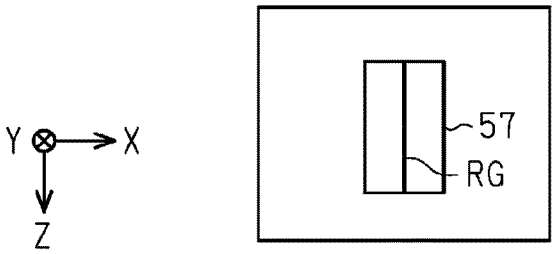
FIG. 23 is a side view of the reflecting portion of FIG. 22 when seen from the inside of the waste liquid container.

As illustrated in FIG. 23, in a case in which the reflecting portion 57 is set to a triangular prism, it is preferable that a prism is disposed so that a ridge line RG formed by intersecting two surfaces of the triangular prism facing the detecting space DS extends in the vertical direction. Here, at the time of performing the suction cleaning, or the like, a large amount of waste liquid flows into the waste liquid container 50 at one time, and the detecting space DS are temporally filled with the waste liquid, and then a liquid surface of the detecting space DS is lowered again by absorbing the waste liquid in the waste liquid absorbing member 71. In such a case, a prism is disposed so that a ridge line RG formed by intersecting two surfaces of the triangular prism extends in the vertical direction, compared to a case in which the ridge line RG extends horizontally, even when the waste liquid is temporally attached to the triangular prism, the waste liquid promptly flows in accordance with lowering of the liquid surface after that, making it possible to avoiding an error detection of the remaining capacity caused by attaching of the waste liquid.

However, in a case in which the waste liquid is leaked from the connection opening 61*a* of the waste liquid container 50 due to some reasons, the waste liquid falls in drops downwardly from the connection opening 61*a*. Also, in the waste liquid container 50 of the embodiment, since the container side terminal portion 56 is disposed lower than the connection opening 61*a*, the waste liquid which is fallen in drops is attached to the container side terminal portion 56 or the apparatus-side terminal portion 41. Then, electric connection of the container side terminal portion 56 and the apparatus-side terminal portion 41 is changed, and thus the controller 100 detects a leak of the waste liquid from the waste liquid container 50.

At this time, since the container side terminal portion 56 and the apparatus-side terminal portion 41 is inclined with respect to both sides of the mounting direction and the vertical direction, when the waste liquid flows down to the container side terminal portion 56 or the apparatus-side terminal portion 41, a flow-down speed of the waste liquid can be slow due to an incline. Accordingly, the controller 100 more reliably detects the leak of the waste liquid, and returning of the waste liquid to the case bottom portion 54, or leaking of the waste liquid to the outside of the liquid ejecting apparatus 11 can be suppressed.

According to the embodiment, effects as follows can be obtained.

(1) When the waste liquid container 50 is mounted on the mounting portion 30, the container side terminal portion 56 is positioned lower than the connection opening 61*a*, if the waste liquid is leaked and fallen from the connection opening 61*a*, and the liquid is attached to the container side terminal portion 56. Then, electrical connection of the container side terminal portion 56 with respect to the apparatus-side terminal portion 41 is changed, and thus the leak of the waste liquid can be detected. In addition, since the container side terminal portion 56 is disposed in a posture inclined with respect to the mounting direction, the waste liquid flowing from the connection opening 61*a* flows along the incline, and can be more efficiently attached to the container side terminal portion 56. Accordingly, the leak can be detected before the waste liquid leaked from the connection opening 61*a* is spread to the vicinity thereof, and the leak of the waste liquid can be initially detected.

(2) When the locking portion 33 is engaged with the engaging portion 63 at the time of being mounted with respect to the mounting portion 30, a position of the waste liquid container 50 is determined, but the engaging portion 63 is disposed on a position aligned with the container side terminal portion 56 in a direction intersecting with the vertical direction, and thus the position the container side terminal portion 56 at the time of mounting can be more accurately determined. Accordingly, an accuracy of connection between the container side terminal portion 56 and the apparatus-side terminal portion 41 can be improved.

(3) The position of the waste liquid container 50 is determined by engaging the locking portion 33 with the engaging portion 63 at the time of being mounted on the mounting portion 30, but the engaging portion 63 is disposed on a position aligned with the reflecting portion 57 in a direction intersecting with the vertical direction, and thus the position of the reflecting portion 57 at the time of being mounted can be more accurately determined. Accordingly, an accuracy when the optical sensor 35 receives the reflected light from the reflecting portion 57 can be improved.

(4) Since light transmitting state of the reflecting portion 57 is changed in response to presence or absence of the waste liquid in the detecting space DS inside the waste liquid container 50, a containing state (remaining capacity shortage) of the waste liquid in the waste liquid container 50 can be detected by the optical sensor 35.

Moreover, the embodiment described above may be changed as a modification example to be described as follows. In addition, the embodiment described above and each modification example can be realized by being suitably combined with each other.

Figure 24:
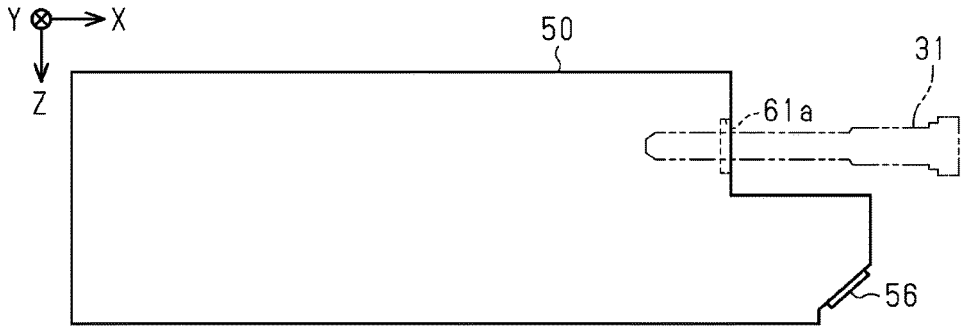
FIG. 24 is a side view illustrating a first modification example of the waste liquid container.
Figure 25:
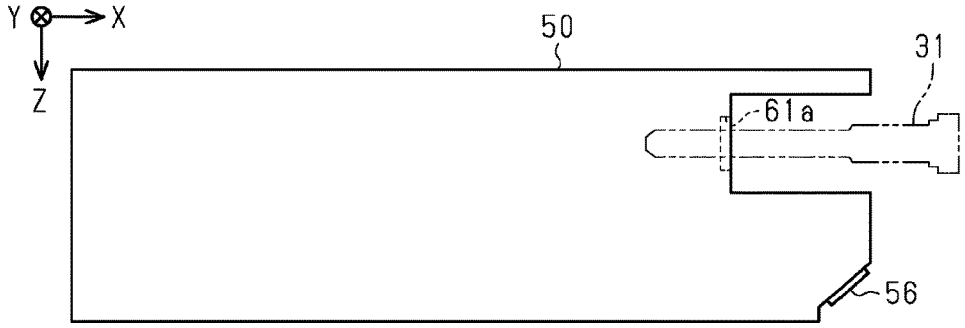
FIG. 25 is side view illustrating a second modification example of the waste liquid container.

As a first modification example illustrated in FIG. 24 or a second embodiment illustrated in FIG. 25, the connection opening 61*a* of the waste liquid container 50 may be disposed on a front side of the mounting direction further than an end portion of a depth side of the mounting direction.

Figure 26:
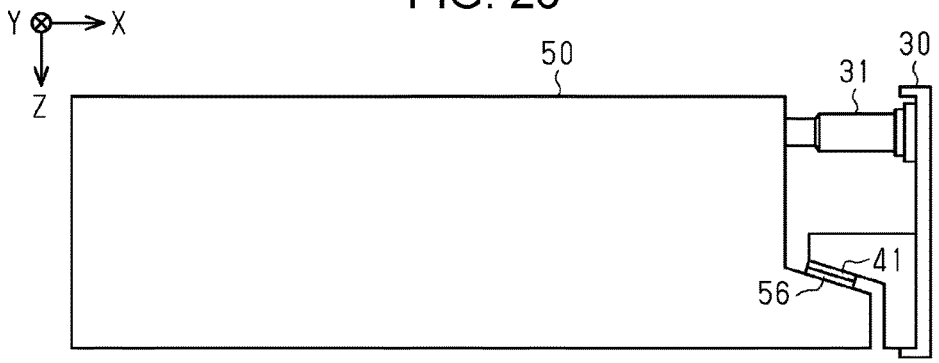
FIG. 26 is a side view illustrating a third modification example of the waste liquid container.

As a third modification example illustrated in FIG. 26, a direction of an incline of the container side terminal portion 56 and the apparatus-side terminal portion 41 may be a reverse direction. That is, in a state in which the waste liquid container 50 is mounted on the mounting portion 30, the apparatus-side terminal portion 41 may be disposed on the container side terminal portion 56.

In the waste liquid container 50, the container side terminal portion 56 may not be necessary to disposed right under the connection opening 61*a*, in a range in which the waste liquid possibly flows down from the connection opening 61*a* may be disposed on the container side terminal portion 56. For example, a groove extending from the connection opening 61*a* toward the container side terminal portion 56 is provided on the waste liquid container 50, and in a case in which flowing down of the waste liquid is induced along the groove, even when positions of the connection opening 61*a* and the container side terminal portion 56 in the transportation direction Y are deviated from each other, the waste liquid leaked from the connection opening 61*a* can be made to flow down to the container side terminal portion 56.

Regardless a containing amount of the waste liquid in the waste liquid container 50, in a case in which the waste liquid container 50 is mounted on appropriate position, the light emitted from the reflecting portion 57 may be reflected toward the light receiving portion 35*b*. In this case, in a case in which the waste liquid container 50 is mounted on the mounting portion 30, the optical sensor 35 receives the light reflected to the reflecting portion 57, and in a case in which the waste liquid container 50 is not mounted on the mounting portion 30, the optical sensor 35 does not receive the light, and thus a mounting state of the waste liquid container 50 can be detected by the optical sensor 35.

The waste liquid container 50 may not be provided with the reflecting portion 57.

The waste liquid container 50 may not be provided with the engaging portion 63 or the contacting portion 64.

The induction flow passage of the waste liquid or the void SP may not be formed inside the waste liquid containing chamber 73 by the notch, or the like of the waste liquid absorbing member 71.

In a case in which the waste liquid introduced in the waste liquid container 50 has a liquidity, which is deteriorated by a thickened viscosity thereof caused by evaporation, or the like, and a possibility of clogging of the induction flow passage is increased, the clogging of the induction flow passage is likely to be detected, a flow passage which communicates the induction flow passage with the detecting space DS may be provided. Meanwhile, in a case in which a possibility of deteriorating of the liquidity caused by the thickened viscosity of the waste liquid is decreased, as the embodiment described above, it is preferable that the detecting space DS is set to a space (a space does not directly communicated with the induction flow passage) which is independent from the induction flow passage.

The waste liquid container 50 is connected to a waste liquid tank which is disposed outside an apparatus main body (case portion) of the liquid ejecting apparatus 11 through a tube, or the like, and may function as an attachment which is mounted on the liquid ejecting apparatus 11 in order to discharge the waste liquid generated inside the liquid ejecting apparatus 11 to the waste liquid tank. In this case, if the waste liquid tank is disposed lower than the discharging portion 31 in the gravity direction, the waste liquid can naturally flow down.

Otherwise, a container connection portion is provided on a front side (vicinity of handle portion 53 in the embodiment described above) in the mounting direction of the waste liquid container 50, and, a waste liquid container (waste liquid tank) disposed outside the apparatus main body (case portion) of the liquid ejecting apparatus 11 may be connected to be detached with respect to the container connection portion. Accordingly, in a case in which the waste liquid container 50 is used as an attachment, the waste liquid container 50 may not be exchanged, and thus the waste liquid container 50 may be fixed without being detached from the liquid ejecting apparatus 11.

The liquid ejecting apparatus 11 is not limited to an apparatus including a line head which has a printing range throughout the entire width of the medium S. For example, the liquid ejecting apparatus 11 may be a serial type apparatus which alternately performs liquid-ejecting performed by moving a carriage holding the liquid ejecting portion 13 in the width direction X along a guide shaft, and transporting of the medium S in the transportation direction Y.

The liquid ejected from the liquid ejecting portion 13 is not limited to ink, for example, may be liquid, or the like in which particles of a functional material are dispersed or mixed with liquid. For example, it is configured that recording is performed by ejecting liquid including a material such as an electrode material or a color material (pixel material), which is used for manufacturing a liquid crystal display, an electro luminescence (EL) display, a surface emission display, and the like in a form of being dispersed or dissolved.

The medium S is not limited to paper, and may be a plastic film, a thin plate material, or the like, or may be a fabric used for a textile printing apparatus. In addition, the medium S is not limited to a sheet shape or a plate shape, for example, may be clothes such as a T-shirt, or a three-dimensional object such as dishes or stationery.

The waste liquid container 50 may be a member which recovers mist scattered in response to ejecting, or the like of the liquid and contains the liquefied waste liquid, and may contain various functional liquid such as cleaning solvent used for cleaning the liquid ejecting portion, or the like, as well as liquid used for ejecting with respect to a target. In addition, in apparatuses other than the liquid ejecting apparatus, for example, the waste liquid container 50 may be a waste liquid container which contains arbitrary waste liquid such as an inspection solution or reagent already used in an inspection, or the like.

An apparatus to which the waste liquid container 50 is mounted is not limited to a liquid ejecting apparatus which ejects liquid, and may be a cleaning apparatus which consumes cleaning liquid and discharges the used cleaning liquid as waste liquid in response to cleaning of a target, or a liquid circulation apparatus which discharges a part of circulating liquid circulated at a predetermined number as waste liquid for exchanging, or the like.

The entire disclosure of Japanese Patent Application No. 2015-202685, filed Oct. 14, 2015 is expressly incorporated by reference herein.

What is claimed is:

1. A waste liquid container which is mounted on a mounting portion including a discharging portion discharging waste liquid and an apparatus-side terminal portion in accordance with movement in a mounting direction, the container comprising:

a waste liquid containing chamber that is capable of containing the waste liquid;

a connection opening that is opened in the mounting direction in a shape of being connectable to the discharging portion; and a container-side terminal portion that is electrically connected to the apparatus-side terminal portion at the time of being mounted on the mounting portion, wherein, in a state of being mounted on the mounting portion, the container-side terminal portion is disposed vertically below an axis passing through the center of the connection opening and inclined with respect to the mounting direction.

2. The waste liquid container according to claim 1, wherein the mounting portion includes a locking portion, wherein the waste liquid container further comprises an engaging portion which is engaged with the locking portion at the time of being mounted on the mounting portion, and wherein the engaging portion is disposed on a position aligned with the container-side terminal portion in a direction intersecting a vertical direction.

3. The waste liquid container according to claim 1, wherein the mounting portion includes an optical sensor which includes a light emitting portion emitting light and a light receiving portion capable of receiving light, and wherein, the waste liquid container further comprises a reflecting portion, which is capable of reflecting light emitted from the light emitting portion to the light receiving portion in a state of being mounted on the mounting portion.

4. The waste liquid container according to claim 3, wherein the mounting portion includes a locking portion, wherein the waste liquid container further comprises an engaging portion which is engaged with the locking portion at the time of being mounted on the mounting portion, and wherein the reflecting portion is disposed on a position aligned with the engaging portion in a direction intersecting a vertical direction.

5. The waste liquid container according to claim 3, wherein the reflecting portion is a prism in which a reflection state of light changes according to the presence or absence of the waste liquid inside the waste liquid container.

6. The waste liquid container to claim 1, wherein one end of the container-side terminal portion is positioned higher than another end of the container-side terminal portion with respect to the mounting direction.

7. The waste liquid container according to claim 1, wherein at least a part of the container-side terminal portion overlaps with the connection opening in a vertical direction in plan view from a surface side where the connection opening is provided.

8. The waste liquid container according to claim 1, wherein the waste liquid container chamber includes a light reflecting portion, wherein the light reflecting portion cooperates with an optical sensor provided in the mounting portion to detect a mounting state of the waste liquid container to the mounting portion.

9. The waste liquid container according to claim 1, wherein the container-side terminal portion is disposed inside a recess portion provided in the waste liquid container.

10. The waste liquid container according to claim 1, wherein, in a state of being mounted on the mounting portion, the container-side terminal portion faces in the mounting direction and a gravity direction.

* * * * *